US010914473B2

(12) United States Patent
Kim et al.

(10) Patent No.: US 10,914,473 B2
(45) Date of Patent: Feb. 9, 2021

(54) OVEN

(71) Applicant: Samsung Electronics Co., Ltd., Suwon-si (KR)

(72) Inventors: Kyoung Mok Kim, Yongin-si (KR); Myoung Keun Kwon, Seoul (KR); Yu Jeong Oh, Suwon-si (KR); In Ki Jeon, Hwaseong-si (KR); Han Jun Sung, Seoul (KR); Jung Soo Lim, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 251 days.

(21) Appl. No.: 15/696,328

(22) Filed: Sep. 6, 2017

(65) Prior Publication Data

US 2018/0073742 A1 Mar. 15, 2018

(30) Foreign Application Priority Data

Sep. 9, 2016 (KR) ..... 10-2016-0116434

(51) Int. Cl.

| | |
|---|---|
| ***F24C 15/00*** | (2006.01) |
| ***F24C 7/06*** | (2006.01) |
| ***F24C 15/20*** | (2006.01) |
| ***F24C 15/32*** | (2006.01) |

(52) U.S. Cl.

CPC ..... *F24C 15/005* (2013.01); *F24C 7/06* (2013.01); *F24C 15/2014* (2013.01); *F24C 15/322* (2013.01)

(58) Field of Classification Search

CPC ... F24C 15/005; F24C 15/322; F24C 15/2014

USPC ..... 99/330, 341, 468; 219/400, 401, 443.1

See application file for complete search history.

(56) References Cited

U.S. PATENT DOCUMENTS

| | | | | |
|---|---|---|---|---|
| 5,818,014 | A | 10/1998 | Smith et al. | |
| 6,318,245 | B1 | 11/2001 | Durth et al. | |
| 6,469,287 | B1 | 10/2002 | Kim | |
| 2003/0116555 | A1* | 6/2003 | Wakefield | F24C 15/2014 219/400 |
| 2004/0069764 | A1* | 4/2004 | Imai | F24C 14/00 219/390 |

(Continued)

FOREIGN PATENT DOCUMENTS

| | | |
|---|---|---|
| DE | 2442940 | 3/1976 |
| EP | 3040621 | 7/2016 |

(Continued)

OTHER PUBLICATIONS

International Search Report dated Dec. 26, 2017 in International Patent Application No. PCT/KR2017/009745.

(Continued)

*Primary Examiner* — Thien S Tran
(74) *Attorney, Agent, or Firm* — Staas & Halsey LLP

(57) ABSTRACT

An oven includes a collision area in which air circulating inside a cooking compartment is collided to reduce the pollution inside of the cooking compartment. A collision area may collectively collect an oil mist condensed by the collision of the air. The collision area is disposed on the side where the flow of air is changed to induce air collision and guide the air to the front side of the cooking compartment to increase air circulation and increase ease of cleaning inside the cooking compartment.

20 Claims, 22 Drawing Sheets

(56) References Cited

U.S. PATENT DOCUMENTS

| | | | | |
|---|---|---|---|---|
| 2004/0163635 | A1 | 8/2004 | Thorneywork | |
| 2005/0039613 | A1* | 2/2005 | Kaminaka | F24C 15/2014 99/476 |
| 2005/0051529 | A1* | 3/2005 | Day | F24C 14/00 219/400 |
| 2005/0236388 | A1 | 10/2005 | Goranson | |
| 2006/0157479 | A1* | 7/2006 | Claesson | A21B 1/245 219/681 |
| 2013/0152913 | A1 | 6/2013 | Raghavan et al. | |
| 2014/0238382 | A1 | 8/2014 | Venkatakrishnan | |

FOREIGN PATENT DOCUMENTS

| | | |
|---|---|---|
| GB | 1557878 | 12/1979 |
| IT | 102011901989137 | 4/2013 |
| JP | 2007-64504 | 3/2007 |
| JP | 5629838 | 10/2014 |
| KR | 10-2007-0064868 | 6/2007 |
| KR | 10-2012-0001884 | 1/2012 |
| KR | 10-1306428 | 9/2013 |
| KR | 10-2016-0075259 | 6/2016 |

OTHER PUBLICATIONS

European Search Report dated Jun. 12, 2019 in European Patent Application No. 17849068.6.
Chinese Office Action dated Feb. 3, 2020 in Chinese Patent Application No. 201780055441.3.
European Communication dated Nov. 3, 2020 in European Patent Application No. 17849068.6.

* cited by examiner

OVEN

CROSS-REFERENCE TO RELATED APPLICATIONS

This application claims the priority benefit of Korean Patent Application No. 10-2016-0116434, filed on Sep. 9, 2016 in the Korean Intellectual Property Office, the disclosure of which is incorporated herein by reference.

BACKGROUND

1. Field

The following description relates to an oven, and more particularly, to a structure to reduce contamination inside a cooking compartment of the oven.

2. Description of the Related Art

Generally, ovens are apparatuses which include a cooking compartment, a heater applying heat to the cooking compartment, and a circulating fan circulating heat generated by the heater in the cooking compartment to cook food.

Ovens are cooking appliances for heating ingredients to cook, and are generally classified into an electric type, a gas type, and an electronic type depending on a heat source thereof. Electric ovens use an electric heater as a heating source, and gas ovens and microwave ovens use heat using gases and frictional heat of water molecules caused by high frequency waves as heat sources, respectively.

When a food is heated, combustion oxides, oil mist, etc. are generated along with water vapor on the surface of the food. The combustion oxides, oil mist, etc. generated at a normal cooking temperature (150 to 250° C.) is discharged to the outside, but a part of the oil mist, etc. are left on the inner wall of the cooking compartment, which is a main cause of pollution and odor of an inner wall in long term use. At this time, the oil mist, etc. is distributed all over the inner wall of the cooking compartment, which is troublesome for a user to clean.

SUMMARY

An aspect of the present disclosure provides an oven in which a user can easily clean the inside of a cooking compartment by densely distributing the distribution of the oil mist distributed on an inner wall of the cooking compartment.

An aspect of the present disclosure provides an oven capable of easily burning densely distributed oil mist to improve the cleanability of the oven.

In accordance with an aspect of the present disclosure, an oven includes a case, a cooking compartment provided inside the case, a fan disposed at one side of the cooking compartment to circulate air inside the cooking compartment, a collision area provided at one side of the cooking compartment so that at least a portion of the air circulated by the fan is collided, and a cover member disposed at the one side of the cooking compartment to cover the fan and guide the air to the collision area.

The oven further includes an air flow path formed between the cover member and the one side of the cooking compartment, wherein the collision area is provided on the air flow path.

The cover member includes an outlet through which the air circulated by the fan is discharged, the air flow path includes a first flow path provided between the fan and the collision area, and a second flow path provided between the collision area and the outlet, the second flow path extends to have an angle of 80 degrees or more with respect to the first flow path.

The oven further includes a heater disposed on the other side of the cooking compartment connected to the one side of the cooking compartment for heating the cooking compartment, and the cover member extends from the one side of the cooking compartment to the other side of the cooking compartment, and the outlet is provided on the cover member side corresponding to the heater.

The collision area is provided on a corner where the one side of the cooking compartment and the other side of the cooking compartment are connected.

The collision area includes a catalyst coating portion disposed on a surface of the collision area to act as a catalyst when an oil mist trapped on the collision area by the collision of the circulated air and the collision area is burned.

The collision area includes a face heating coating portion disposed on a surface of the collision area to heat an oil mist collected on the collision area by the collision of the circulated air with the collision area is burned.

The collision area includes an auxiliary heater disposed adjacent to the collision area to heat an oil mist trapped on the collision area by the collision of the circulated air with the collision area is burned.

The heater includes a hot-wire and a plurality of fins disposed on the hot-wire.

The heater includes a hot-wire and a mesh member covering the hot-wire.

The oven further includes a fan side heater surrounding the fan in an outer circumferential side of the fan.

The cover member further includes an inlet through which air is introduced to the cover member and a filter disposed on the inlet.

The oven further includes a collision member disposed adjacent to an outlet through which air circulated by the fan is discharged to the outside of the cover member.

The collision area is provided on the collision member disposed adjacent to the outlet.

The outlet is formed toward the other side of the cooking compartment connected to the one side of the cooking compartment, the collision member is disposed to be inclined from the one side of the cooking compartment to the other side of the cooking compartment.

The collision member is inclined with respect to a direction of air discharged from the outlet.

The cover member further comprises an inlet having a circular shape through which air circulated by the fan flows into the cover member and the outlet through which air circulated by the fan is discharged to the outside of the cover member, the outlet is disposed so that a distance between one side of the circumference of the fan adjacent to one side of the circumference of the inlet and the outlet is longer than a distance between the center of the inlet and the one side of the circumference of the inlet.

In accordance with an aspect of the present disclosure, an oven includes a case, a cooking compartment provided inside the case, a fan disposed at one side of the cooking compartment to circulate the air inside the cooking compartment, a cover member covering the fan and having a bent portion extending to the other side of the cooking compartment adjacent to the one side of the cooking compartment, and an air flow path formed between the cover member and the one side and the other side of the cooking compartment.

The oven further includes a collision area which is disposed on a corner where the one side of the cooking compartment and the other side of the cooking compartment are connected and in which air flowing in the air flow path collides.

The cover member includes an inlet through which air is introduced and an outlet through which the introduced air is discharged, the air flow path includes a first flow path provided between the inlet port and the collision area, and a second flow path provided between the collision area and the outlet, the second flow path extends so as to have an angle of 80 degrees or more with respect to the first flow path.

The collision area includes a combustion promoting coating portion disposed on a surface of the collision area to promote the burning of an oil mist trapped on the collision area by the collision of the circulated air and the collision area is burned.

In accordance with an aspect of the present disclosure, an oven includes a case, a cooking compartment provided inside the case, a fan disposed at one side of the cooking compartment to circulate air and an oil mist contained in the air inside the cooking compartment, a cover member disposed on one side of the cooking compartment to cover the fan, and including an inlet through which air and the oil mist is introduced by the fan, and a collecting area provided to collect the oil mist introduced into the cover member.

The cover member guides the oil mist to the collecting area so that the oil mist introduced into the cover member collides with the collecting area and is collected in the collecting area.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
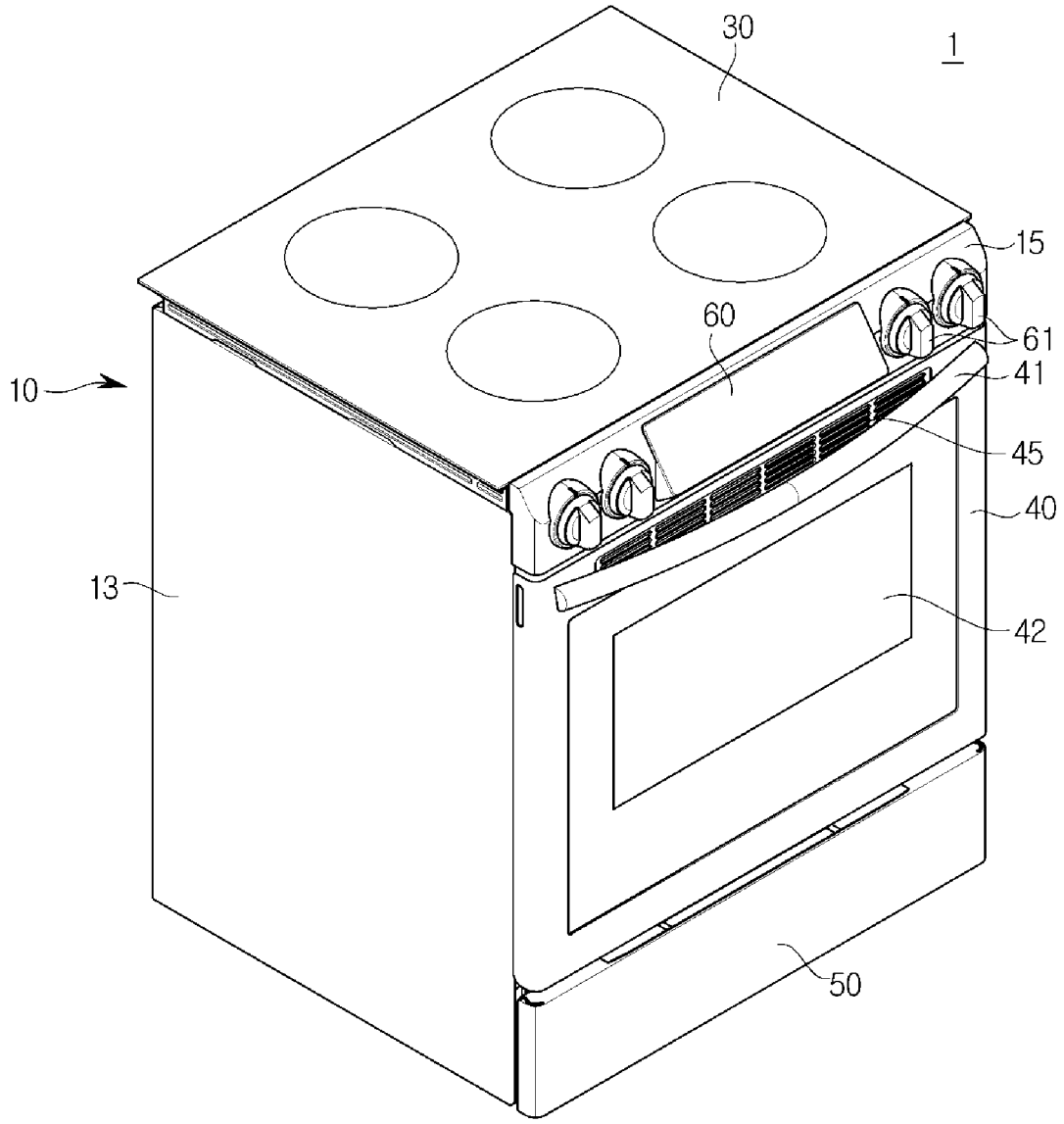
FIG. 1 is a perspective view of an oven according to an embodiment of the present disclosure.

Embodiments described in this specification and configurations illustrated in the drawings are only exemplary examples of the disclosure. The disclosure covers various modifications that may be substituted for the embodiments and drawings herein at the time of filing of this application.

In addition, the same reference numerals or symbols refer to parts or elements that perform substantially the same function.

In addition, terms used in the present specification are merely used to describe exemplary embodiments and are not intended to limit and/or restrict the embodiments. An expression used in the singular form encompasses the expression of the plural form unless it has a clearly different meaning in context. In the present specification, the terms such as "including," "having," and "comprising" are intended to indicate the presence of the features, numbers, steps, actions, elements, parts, or combinations thereof disclosed in the specification, and are not intended to preclude the possibility that one or more other features, numbers, steps, actions, elements, parts, or combinations thereof may be present or added.

In addition, it should be understood that although the terms "first," "second," etc. may be used herein to describe various elements, the elements should not be limited by these terms. These terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

Hereinafter, front and forward used in the following description refer to front and forward directions seen forward from the oven 1 shown in FIG. 1, and rearward refers to the direction towards the rear of the oven 1.

Hereinafter, embodiments of the present disclosure will be described with reference to the accompanying drawings in detail.

Figure 2:
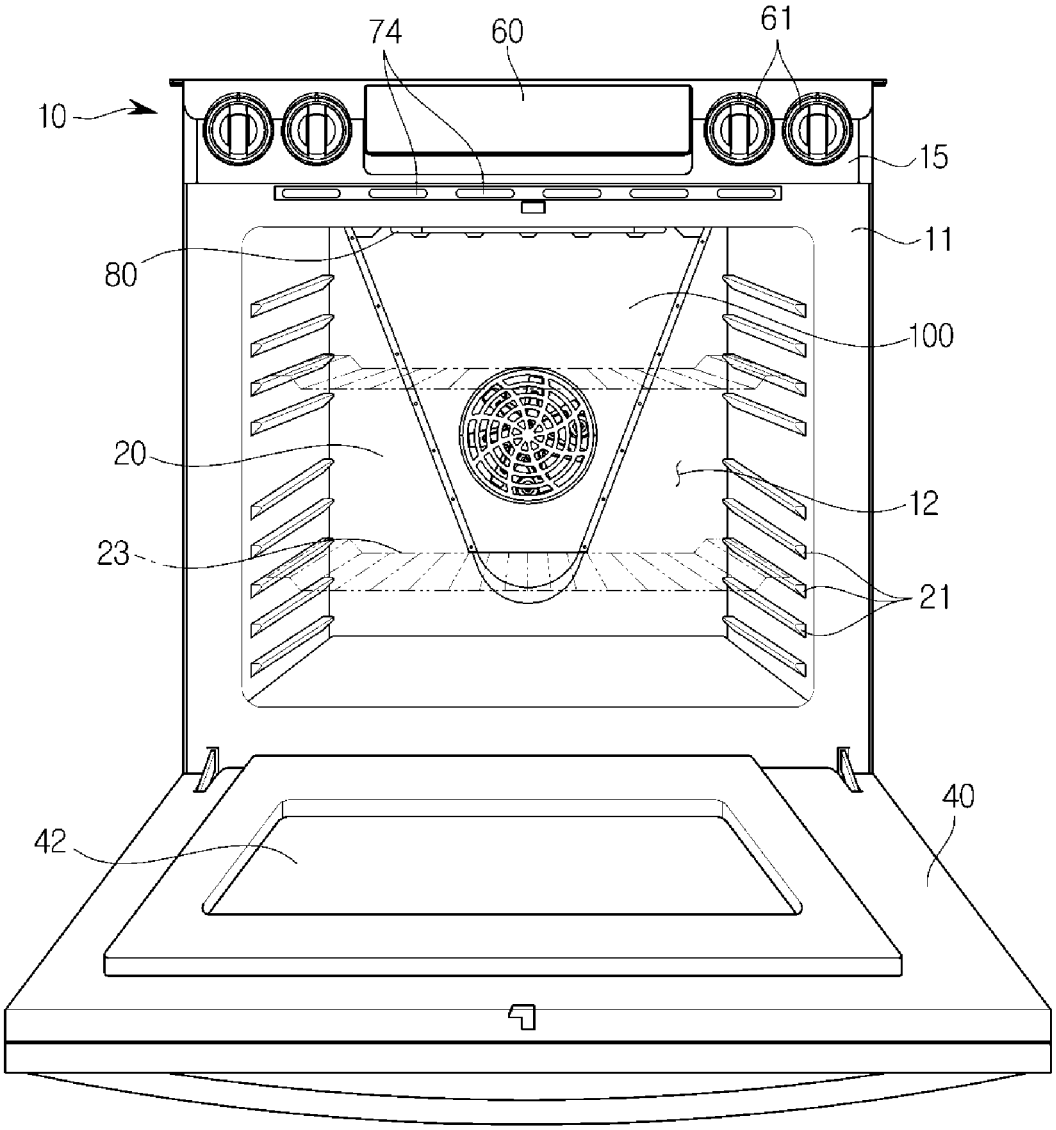
FIG. 2 is view illustrating a state in which a door is opened according to an embodiment of the present disclosure.
Figure 3:
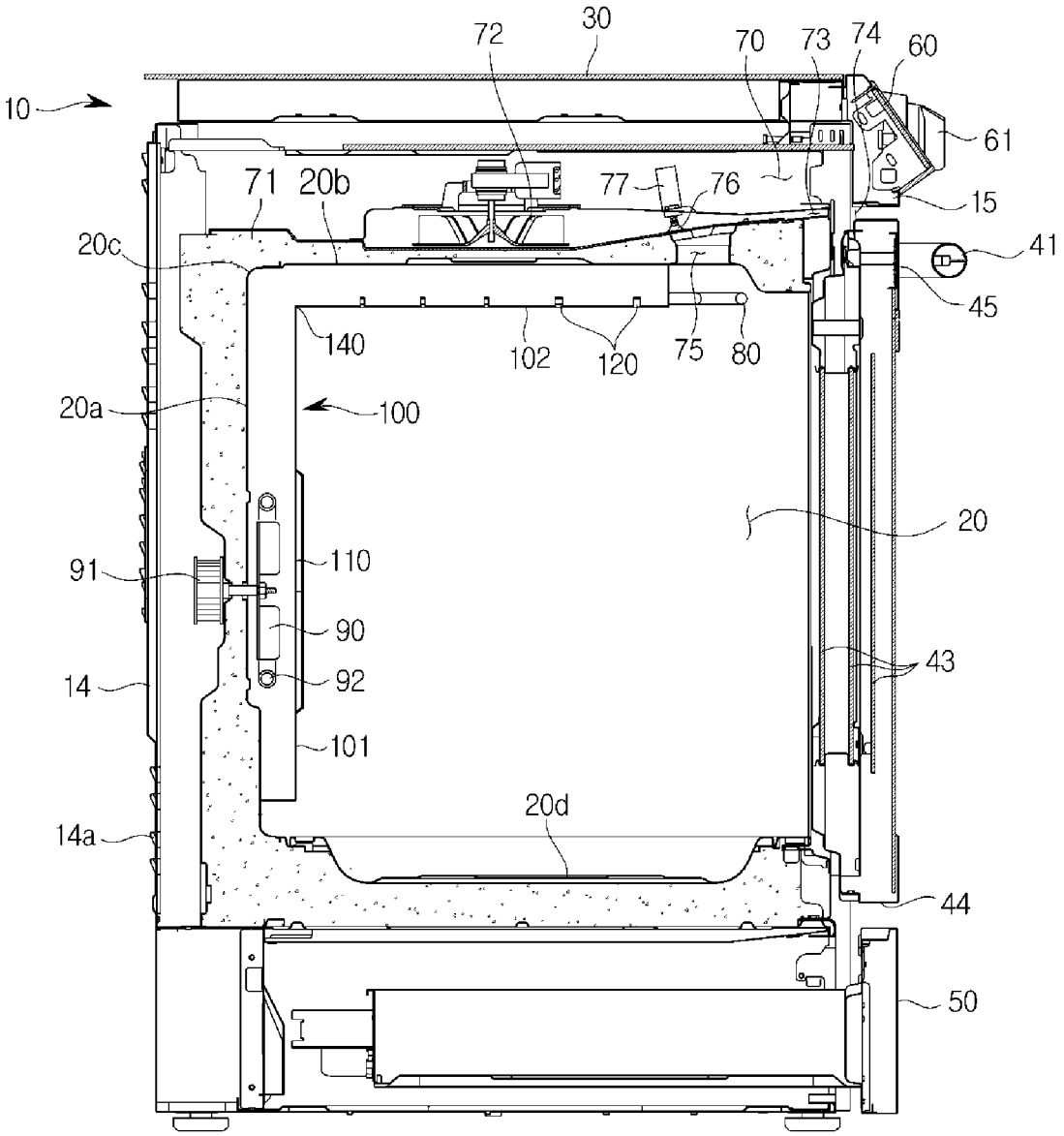
FIG. 3 is a side cross-sectional view of an oven according to an embodiment of the present disclosure.

As shown in FIGS. 1 to 3, the oven 1 (or a body including a case and a door, hereinafter, referred to as the oven 1) may include a case 10 which forms an exterior of the oven 1, a cooking compartment 20 located inside the case 10, and a cooktop 30 provided at a top end of the oven 1 and on which a container with ingredients therein may be placed and heated.

The case 10 may include a front panel 11 which forms a front side of the case 10, a side panel 13 which forms a side of the case 10, and a rear panel 14 which forms a rear side of the case 10.

The cooking compartment 20 may be provided in a box shape inside the case 10 and may have an open front side so ingredients may be placed therein or removed therefrom. An opening 12 provided to correspond to the cooking compartment 20 with the open front side may be provided at the front panel 11.

The open front of the cooking compartment 20 may be opened and closed by a door 40. The door 40 may be hinge-coupled with the bottom of the case 10 to be pivotable with respect to the case 10, and a handle 41 capable of being gripped by a user may be provided at the door 40.

The door 40 may include a transparent portion 42 formed of a transparent material such as glass to allow a process of cooking ingredients inside the cooking compartment 20 to be externally checked.

A plurality of glass members 43 may be provided inside the door 40. The plurality of glass members 43 are for allowing the inside of the cooking compartment 20 to be seen through the transparent portion 42, and may be provided as transparent members other than glass.

A door inlet 44 capable of suctioning air into the door 40 may be provided at a bottom end of the door 40. The door inlet 44 is for cooling heat inside the door 40 by circulating air to prevent heat generated in the cooking compartment 20 from being transferred to an outer surface of the door 40.

Outside air which flows in through the bottom end of the door 40 may be heat exchanged with heat transferred from the cooking compartment 20 while moving toward the top of the door 40 and may be discharged through a door outlet 45 positioned at the front of the door 40.

A storage compartment 50 capable of storing cooking containers, etc. may be provided below the cooking compartment 20. The storage compartment 50 may slide forward and backward to be inserted into or withdrawn from the oven 1.

A plurality of supports 21 may be provided inside the cooking compartment 20. A rack 23 which allows ingredients to be placed thereon may be mounted on the plurality of supports 21. The plurality of supports 21 may be provided to protrude from a left sidewall and a right sidewall of the cooking compartment 20.

A divider (not shown) capable of dividing the cooking compartment 20 may be separably mounted on the plurality of supports 21. In detail, the divider may be horizontally mounted in the cooking compartment 20, and may divide the cooking compartment 20 into a plurality of compartments.

A plurality of the cooking compartments 20 may have the same size and may have different sizes. The divider may include an insulating material and may insulate each of the cooking compartments 20. Through this, spaces of the cooking compartments 20 may be diversely utilized according to the intention of the user.

A heater 80 which heats ingredients may be provided at the cooking compartment 20. In the embodiment, the heater 80 may be an electric heater including an electric resistor. However, the heater 80 may be a gas heater which generates heat by combusting gas. That is, the oven 1 according to the embodiment includes an electric oven and a gas oven.

The heater 80 may be disposed on the side of an upper wall 20*b* of the cooking compartment 20 and may be disposed outside the lower portion of the cooking compartment 20 to heat the inside of the cooking compartment 20.

A rear wall 20*a* of the cooking compartment 20 may be provided with a fan 90 for circulating the air in the cooking compartment 20 to uniformly heat the food and a motor 91 for driving the fan 90. A fan side heater 92 may be disposed outside the outer circumferential surface of the fan 90 in the circumferential direction. A cover member 100 covering the fan 90 may be provided in front of the fan 90. This will be described in detail later.

A display module 60 which displays various types of operational information of the oven 1 and allows the user to input an operational command therein may be provided at an upper front of the front panel 11. The display module 60 may be mounted on an electronic device compartment cover 15.

Also, an operation portion 61 provided to additionally operate the oven 1 may be provided at the electronic device compartment cover 15.

The oven 1 includes an electronic device compartment 70 which accommodates electronic devices which control operations of various components including the display module 60. The electronic device compartment 70 is provided on the top of the cooking compartment 20. An insulator 71 which insulates the electronic device compartment 70 from the cooking compartment 20 may be provided between the electronic device compartment 70 and the cooking compartment 20 to prevent heat in the cooking compartment 20 from being transferred to the electronic device compartment 70.

Also, the insulator 71 may be provided to totally cover the outside of the cooking compartment 20 instead of just between the electronic device compartment 70 and the cooking compartment 20 to prevent the heat of the cooking compartment 20 from being transferred outward from the oven 1.

The oven 1 has a cooling structure which cools the electronic device compartment 70 by circulating air around the cooking compartment 20. The cooling structure of the oven 1 may include a cooling fan unit 72 which moves air and a cooling flow channel 73 which discharges air suctioned by the cooling fan unit 72 to the front of the oven 1.

That is, the air outside a body may be suctioned into the electronic device compartment 70 through a through hole 14*a* formed at the rear panel 14, and the air suctioned into the electronic device compartment 70 may flow inside the electronic device compartment 70 to cool the electronic device compartment 70 and then may ultimately be discharged to the front of the oven 1 through a discharging port 74 along the cooling flow channel 73.

A portion of the air in the cooking compartment 20 may be suctioned into the cooling flow channel 73 through a discharge flow channel 75 and may be discharged to the front of the oven 1. Also, a bypass hole 76 which allows a portion of the air which flows to the discharging port 74 in the cooling flow channel 73 to flow into the discharge flow channel 75 may be additionally formed. The bypass hole 76 may be opened and closed by an opening and closing apparatus 77. A discharge amount of the air in the cooking compartment 20 that is discharged to the cooling flow channel 73 may be adjusted according to the opening and closing of the bypass hole 76.

Hereinafter, the fan 90 for circulating the air inside the cooking compartment 20 and the cover member 100 covering the fan 90 will be described in detail.

Figure 4:
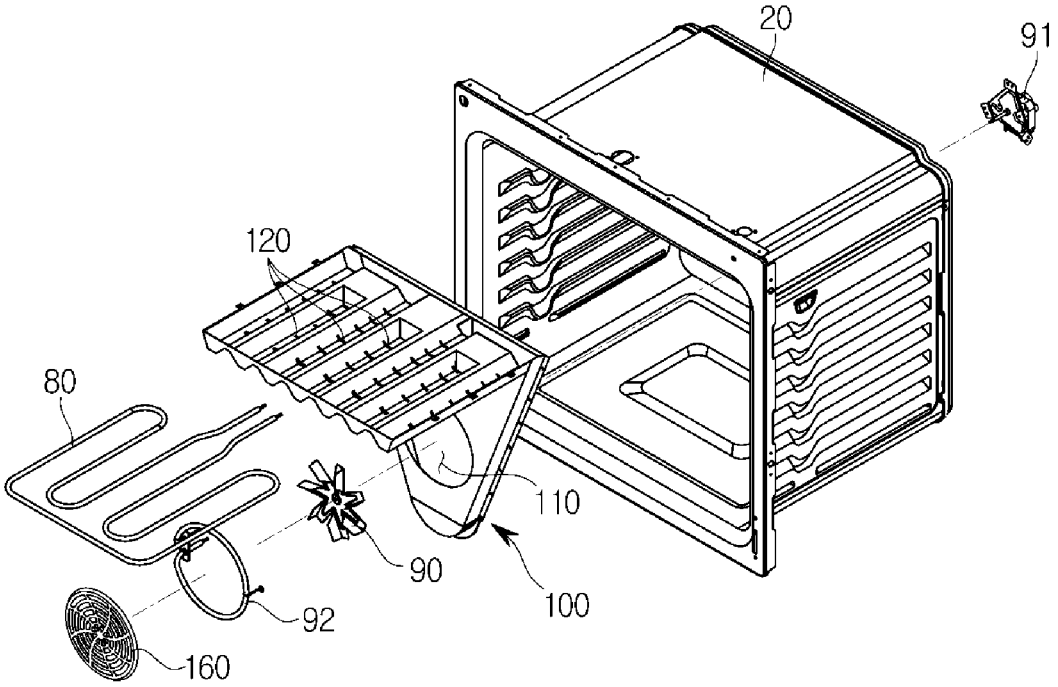
FIG. 4 is an exploded perspective view of a cooking compartment and an internal configuration of an oven according to an embodiment of the present disclosure.
Figure 5:
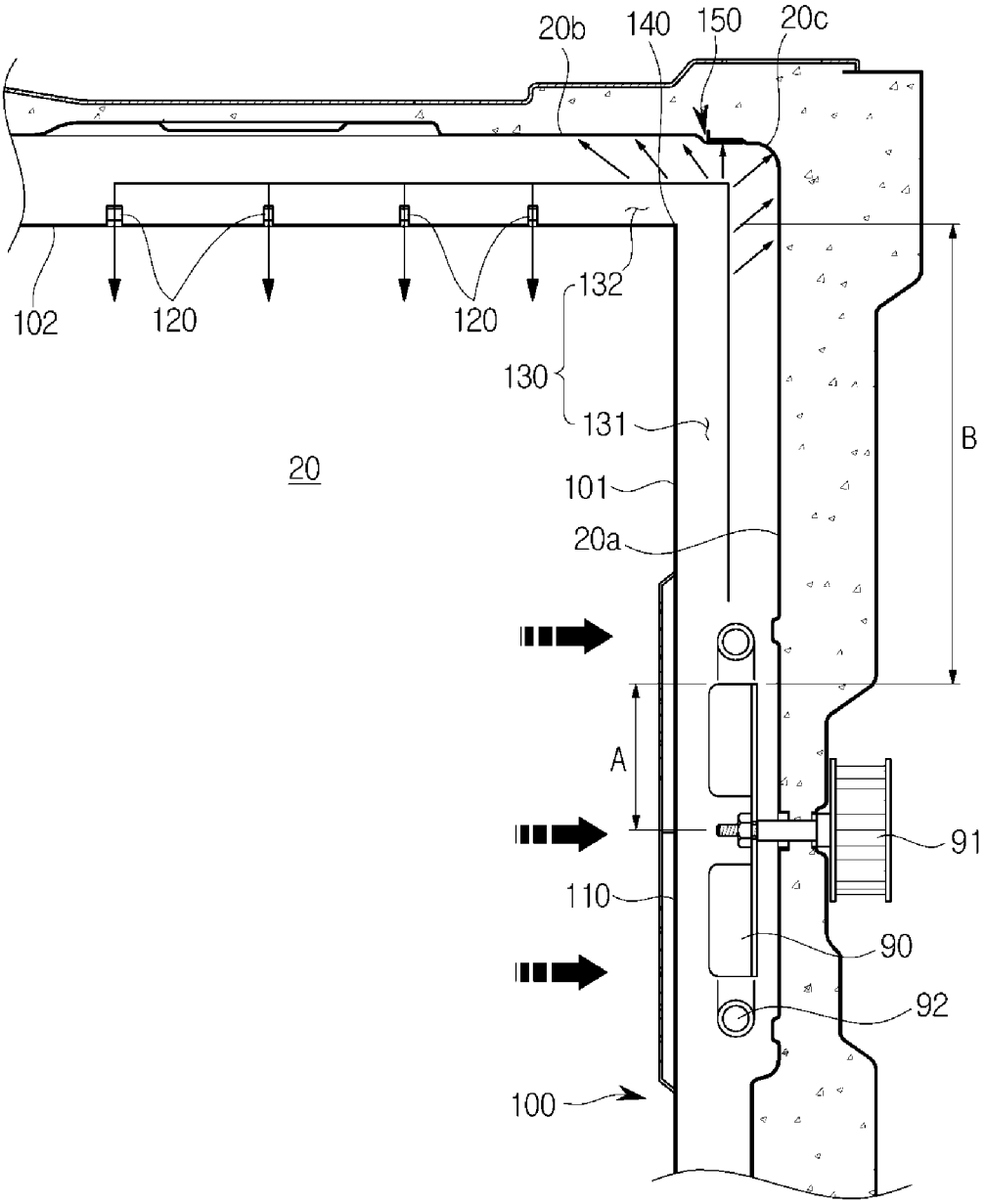
FIG. 5 is a side cross-sectional view of a portion of an oven according to an embodiment of the present disclosure.

As shown in FIGS. 4 and 5, the cover member 100 may be disposed on the rear wall 20*a* of the cooking compartment 20 in which the fan 90 is disposed. The cover member 100 may include an inlet 110 through which the air is introduced by the fan 90 and an outlet 120 through which the introduced air is discharged.

The air introduced from the inlet 110 may be discharged to the outlet 120 through an air flow path 130 formed in a space provided between the rear surface of the cover member 100 and the cooking compartment 20.

A grill 160 including a plurality of holes may be provided on the inlet 110 to prevent foreign matter from entering the inside of the cover member 100.

The cover member 100 includes a first cover portion 101 that is disposed to correspond to the rear wall 20*a* to cover at least a portion of the rear wall 20*a* and cover the fan 90, and a second cover portion 102 disposed to correspond to the upper wall 20*b* that is bent at the rear wall 20*a* to cover at least a portion of the upper wall 20*b*.

The cover member 100 may include a bent portion 140 that is bent at a first corner portion 20*c* where the rear wall 20*a* and the upper wall 20*b* are connected. The bent portion 140 may be disposed at an edge where the first cover portion 101 and the second cover portion 102 are connected. The cover member 100 may be bent to extend from the rear wall 20*a* to the upper wall 20*b* by the bent portion 140.

The inlet 110 may be disposed in the first cover portion 101 and the outlet 120 may be disposed in the second cover portion 102. The air flow path 130 may extend along the rear surface of the cover member and the rear side wall 20*a* and the upper wall 20*b*. That is, the air flow path 130 may be formed in a sickle shape to have an air flow angle of about 90 degrees.

The second cover portion 102 may be disposed to face the upper wall 20*b* with a gap therebetween. A surface facing the upper wall 20*b* of the second cover portion 102 forms the air flow path 130 and the heater 80 may be disposed on the opposite surface of the second cover portion 102.

A plurality of bumps may be formed on the opposite surface of the second cover portion 102 so that the heater 80 is disposed. A hot-wire 81 of the heater 80 may be disposed on a concave portion of the plurality of bumps and the outlet 120 may be disposed on a convex portion of the plurality of bumps.

The second cover portion 102 is not limited to the embodiment of the present disclosure and may be formed in various forms. The heater 80 may be formed on the inner side of the cooking compartment 20, but can be supported by other configurations.

The air circulated inside the cooking compartment 20 is guided to the rear wall 20*a* of the cooking compartment 20 by the fan 90 and flows into the cover member 100 and is heated by the fan side heater 92 disposed adjacent to the outer peripheral surface of the fan 90.

Then, the air flows to the upper wall 20*b* along the air flow path 130 and to the outlet 120 toward the lower wall 20*d* from the upper wall 20*b*.

The heater 80 is disposed adjacent to the outlet 120 to heat the discharged air and the heated air is circulated in the cooking compartment 20 and then moved to the rear wall 20*a* by the fan 90 again.

The air flow path 130 includes a first flow path 131 formed between the first cover portion 101 and the rear wall 20*a* and a second flow path 132 extending from the first flow path 131 and formed between the second cover portion 102 and the upper wall 20*b*.

The first flow path 131 and the second flow path 132 may be bent and extended by the bent portion 140. In detail, the second flow path 132 may extend to have an angle of 80 degrees or more with respect to the first flow path 131. According to an embodiment of the present disclosure, the second flow path 132 may have an angle of about 90 degrees with respect to the first flow path 131.

The air introduced into the cover member 100 through the inlet 110 flows to the upper side of the cooking compartment 20 through the first flow path 131 and then flows toward the front of the cooking compartment 20 along the second flow path 132 and may be discharged toward the lower wall 20*d* of the cooking compartment 20 through the outlet 120 while being moved toward the front side of the cooking compartment 20.

The first flow path 131 and the second flow path 132 are connected between the bent portion 140 and the first corner portion 20*c*. The circulated air is guided toward the upper wall 20*b* by the first flow path 131 and collided with the first corner portion 20*c* and the upper wall 20*b* adjacent to the first corner portion 20*c*. Then, the circulated air may be guided by the second flow path 132 and flow toward the outlet 120 side.

That is, the air introduced through the inlet 110 may be guided by the cover member 100 to collide with the first corner portion 20*c* or the upper wall 20*b* adjacent to the first corner portion 20*c*.

A collision area 150 disposed on the first corner portion 20*c* and the upper wall 20*b* adjacent to the first corner portion 20*c* where air flowing in the air flow path 130 collides in is provided in the cooking compartment 20.

The collision area 150 is an area where air collides along the air flow path 130 that is not specified as one area. The air flow path 130 may be formed differently depending on the shape of the first corner portion 20*c*, the rear wall 20*a*, and the upper wall 20*b*.

The collision area 150 may be provided on the air flow path 130 so that at least a portion of the air that is flowing may collide with the collision area 150.

In the case of the conventional oven, oil mist generated during cooking is circulated to the entire inside of the cooking compartment through the fan, and collides with the inner walls of the cooking compartment and the rear surface of the door, thereby causing a problem in that the entire cooking compartment is contaminated by the oil mist.

As a result, the user has to clean the entire cooking compartment. According to an embodiment of the present disclosure, air circulating in the cooking compartment 20 collides with the collision area 150 by the cover member 100. Accordingly, it is possible to solve the problem that most of the oil mist circulating in the cooking compartment 20 or spread over the entire cooking compartment 20 is collected in the collision area 150.

The oil mist is burned when the oil mist is heated at a high temperature between 400° C. and 500° C. But at a normal cooking temperature (150~250° C.), if the oil mist collides with one side of the cooking compartment 20, then the oil mist may not be burned but condense on the cooking compartment 20. Because the oven 1 includes the collision area 150 that easily collects the oil mist in the space inside the cooking compartment 20, the user does not have to clean the entire cooking compartment, but rather only the collision area 150.

The collision area 150 is an area where the air circulated by the air flow path 130 and the oil mist contained in the air collide and are collected. Thus, the collision area 150 may also be referred to as a collecting area.

The collision area 150 may guide the flow of the air to flow into the second flow path 132 by colliding with the air flowing along the first flow path 131 and collect the oil mist contained in the air.

The collision area 150 guides the air flowing toward the rear side of the cooking compartment 20 by the fan 90 toward the front side of the cooking compartment 20 to smooth the circulation of the air inside the cooking compartment 20. It is then possible to reduce the contamination in the cooking compartment 20 excluding the collision area 150 by collecting the oil mist on the collision area 150.

As shown in FIG. 5, the cover member 100 is provided so that a first distance A as a distance from a rotation axis of the fan 90 to an outer peripheral surface of the fan 90 is shorter than a second distance B as a linear distance from the outer peripheral surface of the fan 90 to the outlet 120.

The air circulating in the cooking compartment 20 is introduced into the cover member 100 by the fan 90 and then heated by the fan side heater 92 disposed on the outer peripheral side of the fan 90. After that, the air may flow to the outlet 120.

The air flowing along the air flow path 130 after being heated by the high temperature fan side heater 92 may reach a temperature at which the oil mist may be condensed. The distance from the fan side heater 92 increases and the temperature is cooled. At this time, if the oil mist that reached the condensation temperature collides on a surface of one side of the inner wall of the cooking compartment 20, the oil mist that reached the condensation temperature would condense on the surface of one side of the inner wall of the cooking compartment 20.

As a result, the amount of the oil mist condensed on the inner wall of the cooking compartment 20 increases. In order to prevent this, the second distance B may be set to be longer than at least the first distance A. The second distance B may be set to be longer than the first distance A and then the air heated in the fan side heater 92 may condense on the air flow path 130 before being discharged through the outlet 120. Thereby it is possible to prevent the condensation of the oil mist within the cooking compartment 20 except for the cover member 100.

When the oil mist is condensed in the air flow path 130, the fan side heater 92 may be intermittently operated to easily remove the oil mist, and it is not visible to the user that condensation of the oil mist occurs in the cooking compartment 20 and thus it is possible to enhance an aesthetic sense of the oven.

Hereinafter, a structure for removing the vapor trapped in the collision area 150 will be described in detail.

Figure 6:
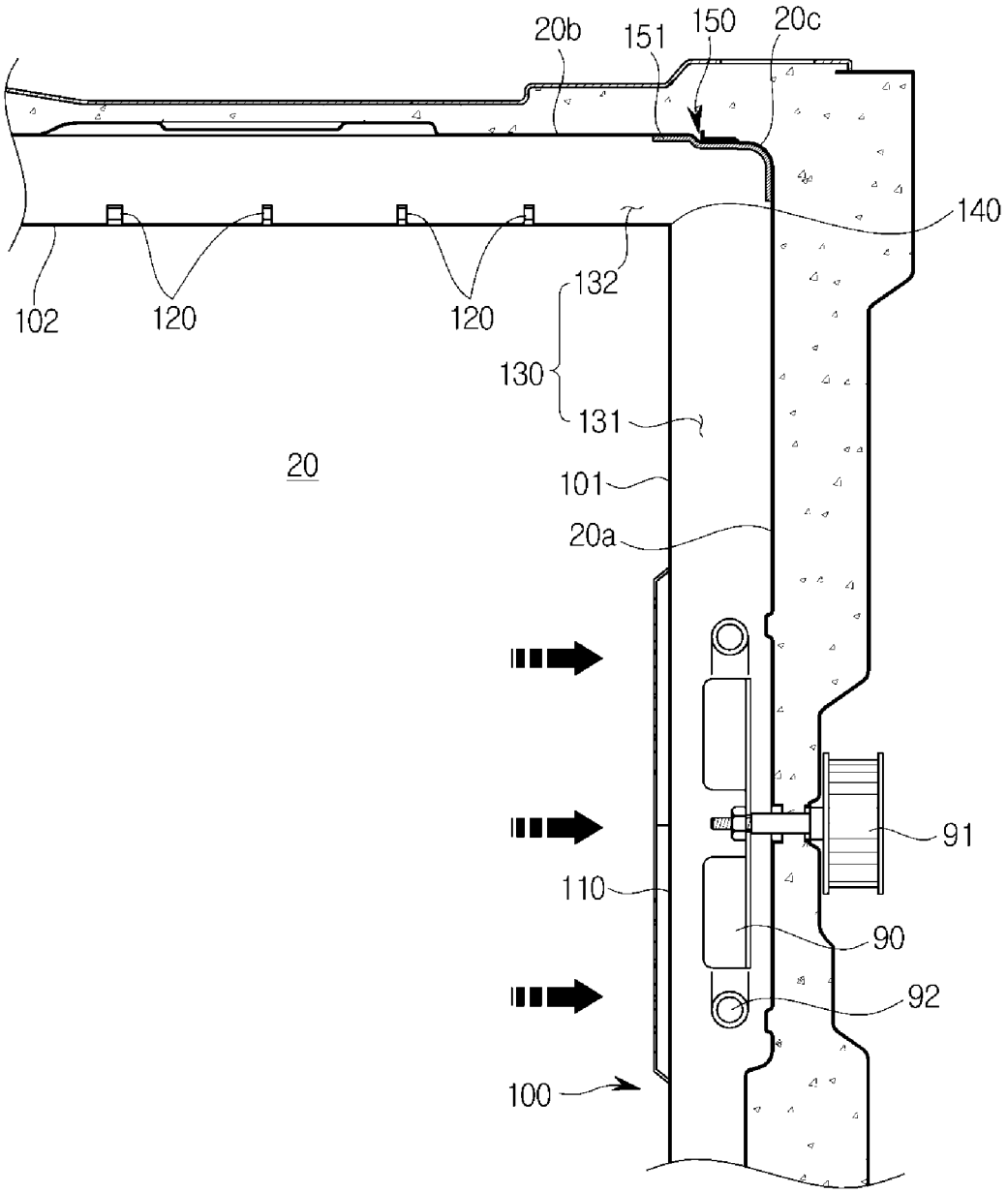
FIG. 6 is a side cross-sectional view of a portion of an oven according to an embodiment of the present disclosure.

As shown in FIG. 6, the collision area 150 may include a combustion promoting coating portion 151 that promotes combustion of the oil mist collected on the surface of the collision area 150.

In the case of the conventional oven, in order to remove the oil mist condensed in the cooking compartment, the inside of the cooking compartment may be heated at a high temperature through a heater during the cleaning mode of the oven to burn the oil mist.

At this time, the heater heats the cooking compartment at a temperature of 400° C. to 500° C. The time required for reaching the temperature for the cleaning mode takes a long period of time and so does the time required for cooling the inside of the cooking compartment after the cleaning mode of the oven.

Moreover, because the temperature inside the cooking compartment is maintained at 150 to 250° C. in the cooking mode, some of the oil mist collides with the inside of the cooking compartment and condenses on the surface of the inside of the cooking compartment during the cooking mode.

In order to prevent this, the oven 1 according to an embodiment of the present disclosure includes the combustion promoting coating portion 151 that may easily remove condensed oil mist even in a cooking mode in the collision area 150 where the oil mist is collected.

The combustion promoting coating portion 151 may be provided in the form of a surface film to be layered on the surface of the collision area 150. Therefore, the oil mist in the circulated air may collide with the surface of the combustion promoting coating portion 151 and condense.

The combustion promoting coating portion 151 helps burn the oil mist so that the condensed oil mist in the combustion promoting coating portion 151 may be burned even at a temperature of 400° C. or lower. Therefore, even in the cooking mode, not the cleaning mode of the oven 1, a portion of the oil mist may be burned to improve the cleaning efficiency.

The combustion promoting coating portion 151 may include a catalytic coating including a catalyst that promotes chemical decomposition in the process of burning the oil mist.

The oil mist containing triglycerides may be decomposed into carbon molecules and carbon dioxide and water at high temperatures above 400° C. When a component such as platinum (Pt) or palladium (Pd) is added during the process of decomposition of the oil mist at a high temperature, the oil mist may be decomposed by burning at a temperature of about 300° C. Therefore, the combustion promoting coating portion 151 may be provided to be coated with a catalyst element such as platinum or palladium.

When the collected oil mist on the surface of the combustion promoting coating portion 151 is heated, platinum or palladium, which forms the surface of the combustion promoting coating portion 151, acts as the catalyst and the oil mist trapped in the collision area 150 may be burned even at a temperature of 400° C. or lower.

The combustion promoting coating portion 151 may include a surface heating coating. The surface heating coating may consist of exothermic materials that may generate heat through electrical connections.

Although not shown in the drawing, wires may be connected to the combustion promoting coating portion 151. When electricity is applied to the surface heating coating along the electric wire, the surface of the combustion promoting coating portion 151 may be heated by exothermic materials of the surface heating coating.

The surface heating coating may generate a high temperature of 400° C. or more when the electricity is connected. Accordingly, the collected oil mist colliding with the combustion promoting coating portion 151 may be burned and removed by the surface heating coating.

Therefore, the collected oil mist may be removed without heating the heater 80 to 400° C. or higher. In addition to the cleaning mode of the oven 1, the oil mist may be removed by heating the surface heating coating even during the cooking mode. Accordingly, it is possible to continuously remove the circulating oil mist in the air to lower the pollution degree of the cooking compartment 20.

Hereinafter, an auxiliary heater 152 disposed in the collision area 150 according to an embodiment of the present disclosure will be described. The configuration other than the auxiliary heater 152 described below is the same as the configuration according to the embodiment described above, and a description thereof will be omitted.

Figure 7:
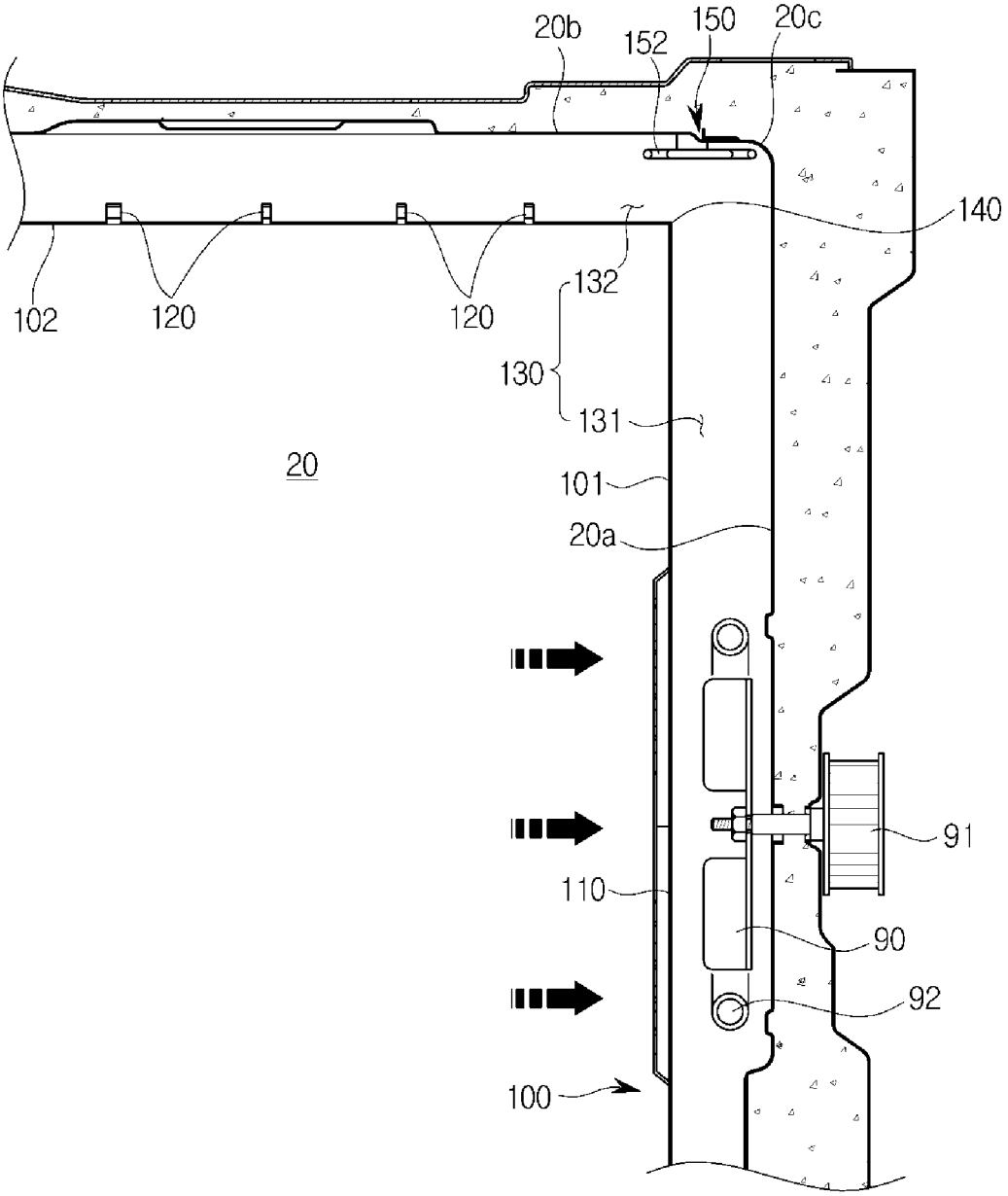
FIG. 7 is a side cross-sectional view of a portion of an oven according to an embodiment of the present disclosure.
Figure 8:
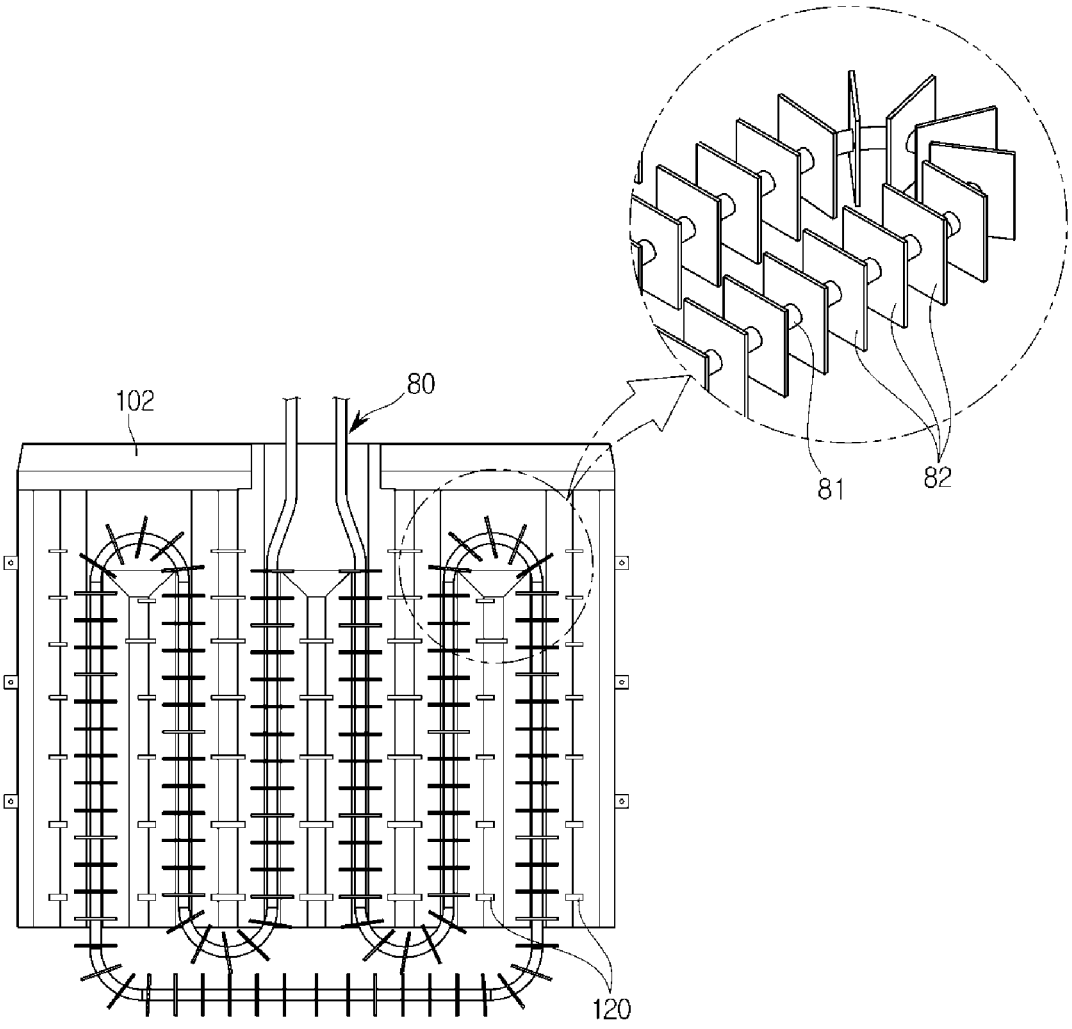
FIG. 8 is a view showing a part of the structure of an oven according to an embodiment of the present disclosure.

As shown in FIG. 7, the collision area 150 may include the auxiliary heater 152 for heating the collision area 150.

The auxiliary heater 152 is disposed adjacent to the collision area 150 to heat the oil mist trapped in the collision area 150 to remove the oil mist.

The auxiliary heater 152 may be intermittently operated during the cleaning or cooking mode of the oven 1 to remove the oil mist collected in the collision area 150 at any time. Therefore, it is possible to reduce the pollution degree of the cooking compartment 20 by continuously removing the circulating oil mist in the air.

Hereinafter, a fin 82 of the heater 80 and a mesh member 83 of heaters 80 and 80' according to an embodiment of the present disclosures will be described. The configurations other than the configurations of the heaters 80 and 80' described below are the same as those of the above-described embodiment, and a description thereof will be omitted.

The air discharged by the outlet 120 may be heated by the heater 80 disposed adjacent to the outlet 120 and circulated inside the cooking compartment 20. Therefore, the air discharged through the outlet 120 passes through an area adjacent to the heater 80 before circulating in the cooking compartment 20.

The heater 80 according to an embodiment of the present disclosure collides with at least a portion of the discharged air passing through the area adjacent to the heater 80 so that the oil mist contained in the air collides and is collected on a side of the heater 80 before condensation on the inside of the cooking compartment 20 so that contamination of the inside of the cooking compartment 20 may be prevented.

The heater 80 may include a plurality of fins 82 disposed on the heated hot-wire 81. As the plurality of fins 82 are arranged along the hot-wire 81, the discharged air passing through the area adjacent to the heater 80 may collide with the plurality of fins 82.

The oil mist contained in the air may condense on the surfaces of the plurality of fins 82 after colliding with the plurality of fins 82 and may be collected by the plurality of fins 82.

The heater 80 heats the hot-wire 81 to heat the inside of the cooking compartment 20 and the plurality of fins 82 connected to the hot-wire 81 is also heated to a temperature corresponding to the temperature at which the hot-wire 81 is heated.

When the plurality of fins 82 are heated to a temperature of 400° C. or more as the hot-wire 81 is heated, the oil mist collected in the plurality of fins 82 may be burned and removed.

Figure 9:
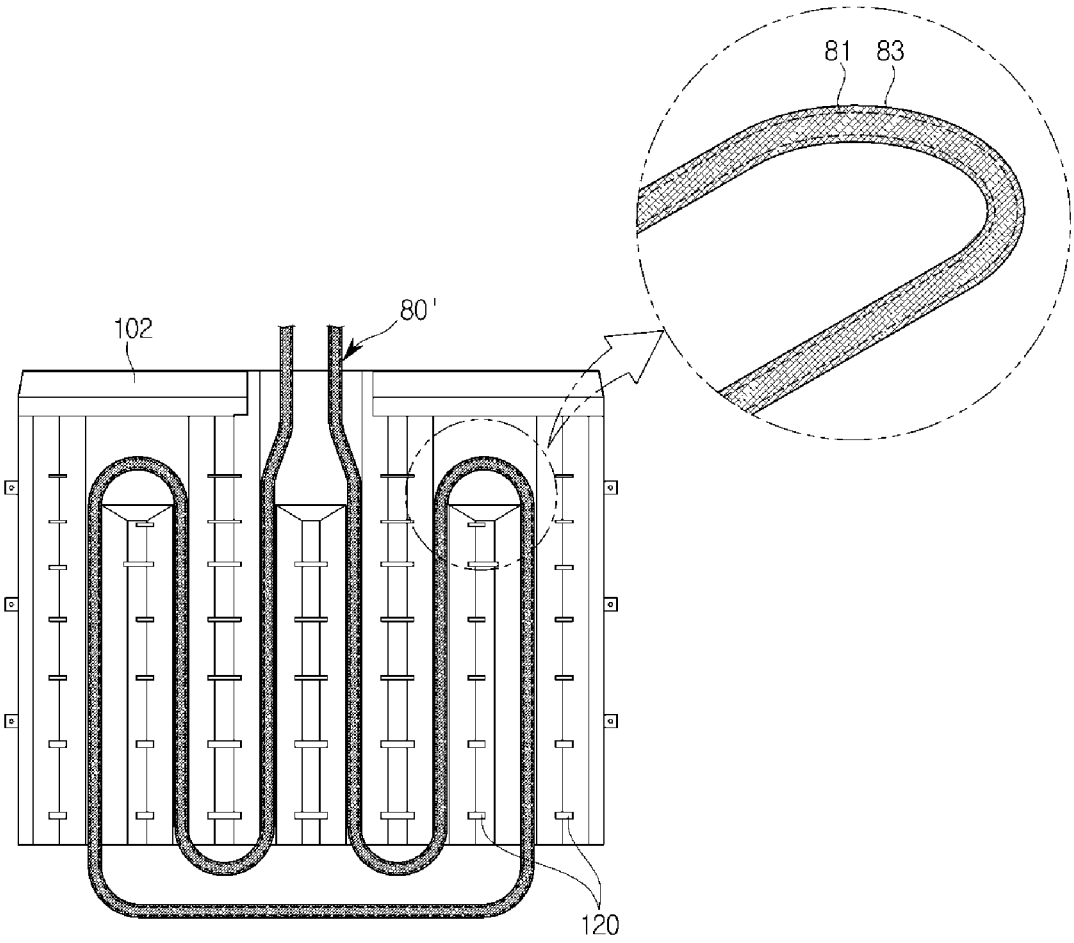
FIG. 9 is a view showing a part of the structure of an oven according to an embodiment of the present disclosure.

As shown in FIG. 9, according to an embodiment of the present disclosure the heater 80' may include the mesh member 83 formed along the outer circumferential surface of the hot-wire 81 to be heated.

The mesh member 83 may collect the oil mist contained in the discharged air passing through the area adjacent to the heater 80' similar to the plurality of fins 82 described above. That is, when the discharge air collides with the mesh member 83, the oil mist contained in the discharge air may collide with the mesh member 83 and then condense on a surface of the mesh member 83 and be collected in the mesh member 83.

When the temperature of the surface of the mesh member 83 is heated to 400° C. or more by the heating of the heater 80', the oil mist collected in the plurality of fins 82 may be burned and removed. The mesh member 83 may be provided in various shapes and sizes, and may be formed in various shapes capable of collecting the oil mist, not only in the mesh shape but others.

Hereinafter, a heater 80" according to an embodiment of the present disclosure will be described. The configuration other than the configuration of the heater 80" described below is the same as the configuration according to the above disclosure and a description thereof will be omitted.

Figure 10:
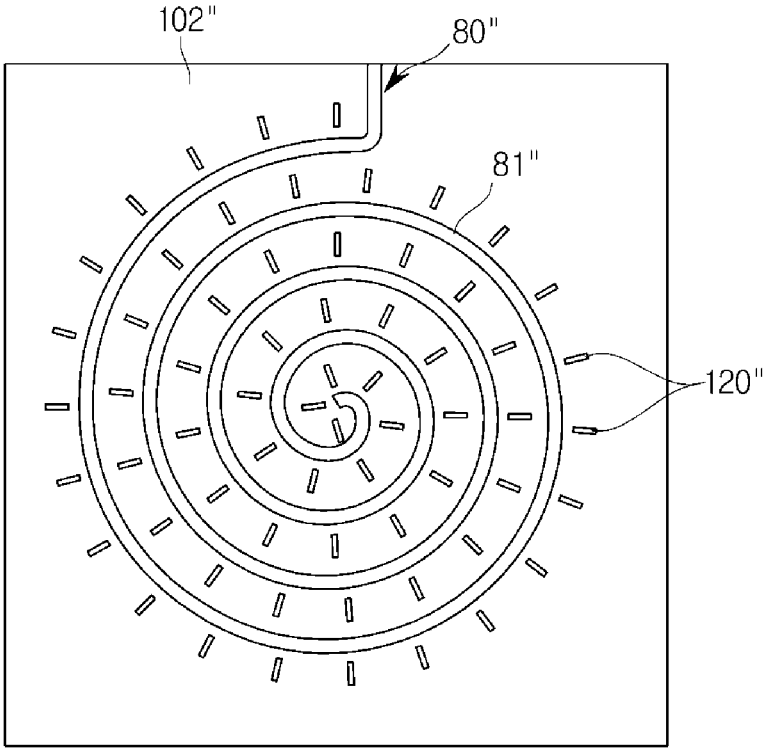
FIG. 10 is a view showing a part of the structure of an oven according to an embodiment of the present disclosure.

As shown in FIG. 10, the heater 80" may include a hot-wire 81" having a large surface area to collect the oil mist from the heater 80" before the oil mist contained in the air is discharged through the outlet 120" and circulated into the cooking compartment 20.

The hot-wire 81" is directed from the outermost side of the heater 80" to the center of the heater 80" in order to dispose the hot-wire 81" having the widest surface area on a second cover portion 102" and may extend in an annular shape.

As the surface area of the hot-wire 81" increases, the amount of the discharged air that collides on the hot-wire 81" through the area adjacent to the heater 80" may be increased. Therefore, when the hot-wire 81" is heated, the collected oil mist on the surface of the hot-wire 81" may be burned and removed.

The hot-wire 81" is not limited to an embodiment of the present disclosure and may extend in various shapes. That is, in order to increase the surface area of the hot-wire 81" on the second cover portion 102", the hot-wire 81" may be formed in a straight-line shape having a plurality of bending shapes and may be formed to include a polygonal shape.

Hereinafter, a filter 161 according to an embodiment of the present disclosure will be described.

Figure 11:
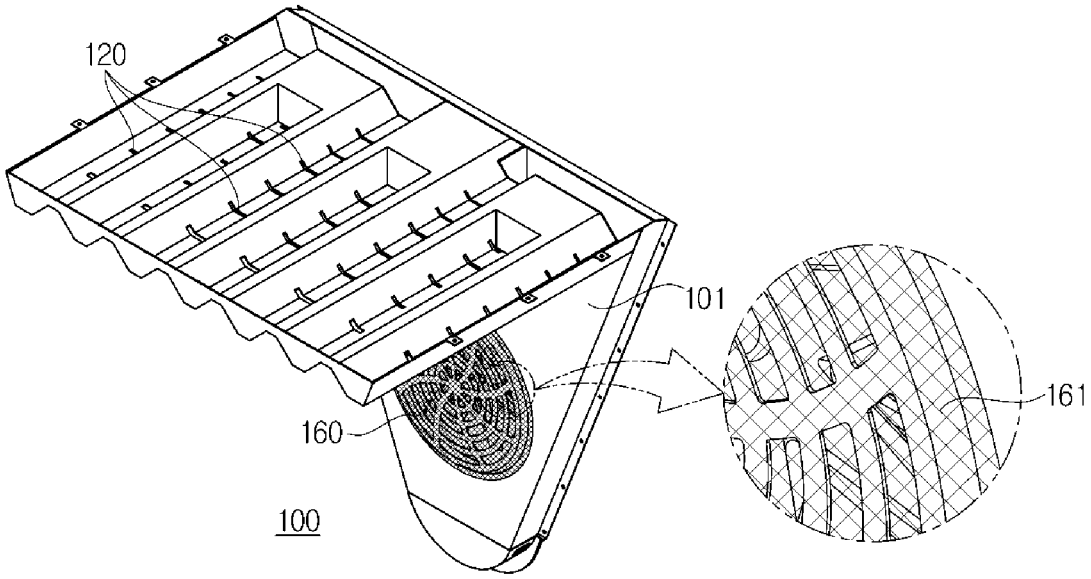
FIG. 11 is a view showing a part of the structure of an oven according to an embodiment of the present disclosure.
Figure 12:
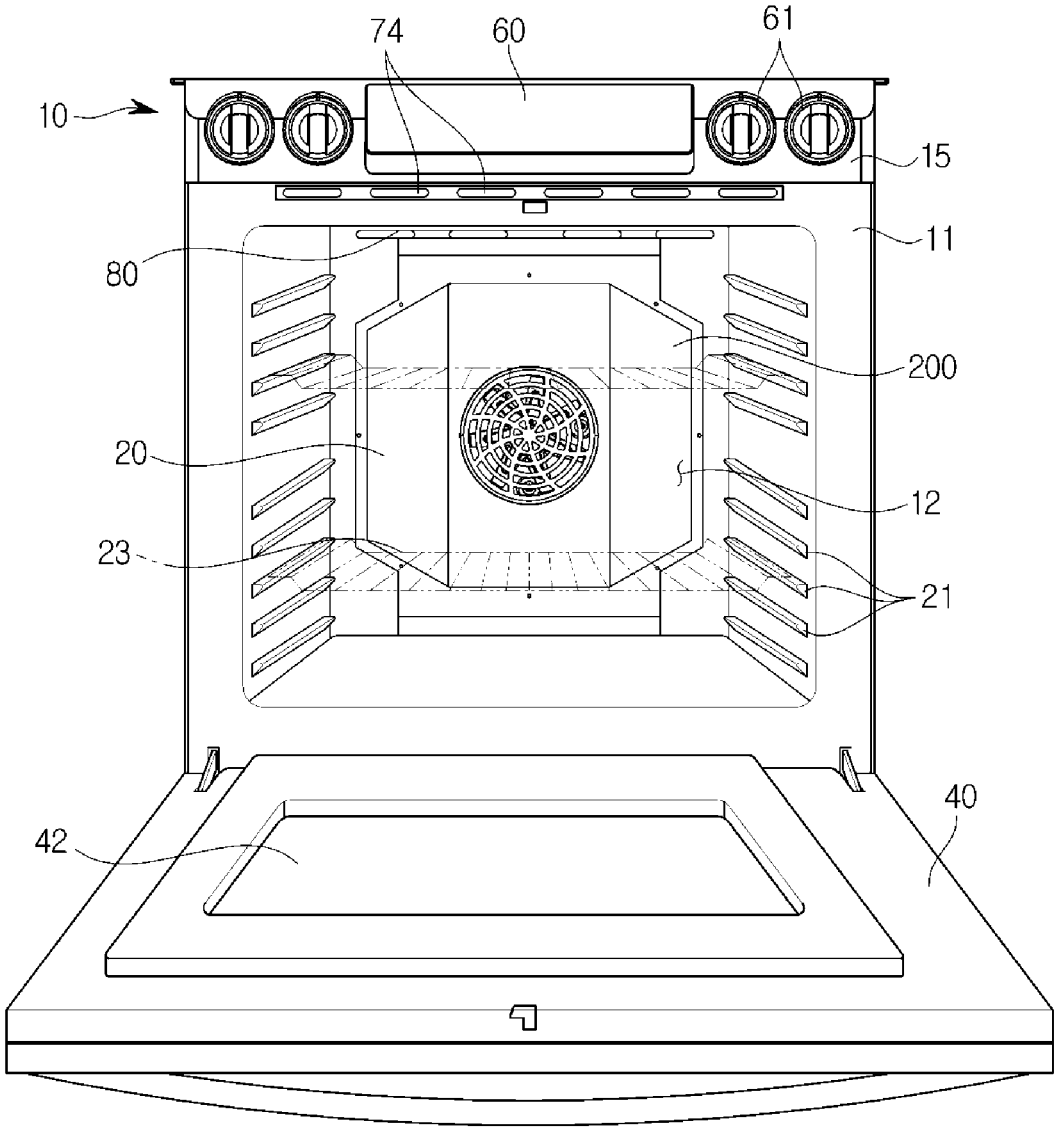
FIG. 12 is a view illustrating a state in which the door of the oven is opened according to an embodiment of the present disclosure.
Figure 13:
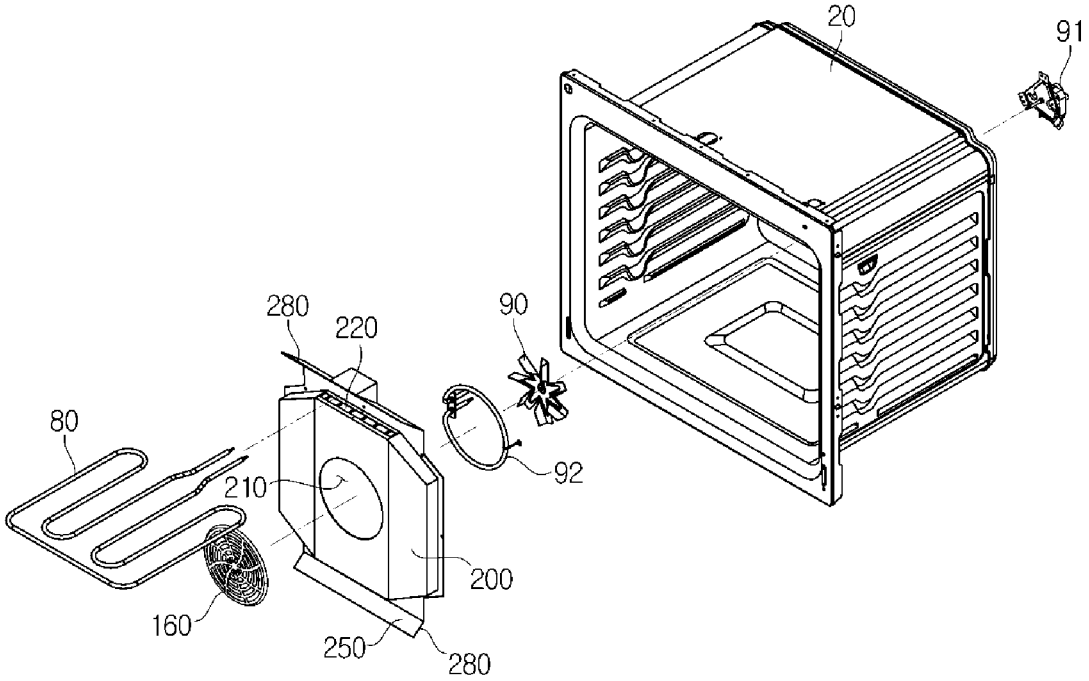
FIG. 13 is an exploded perspective view of a cooking compartment and an internal configuration of an oven according to an embodiment of the present disclosure.
Figure 14:
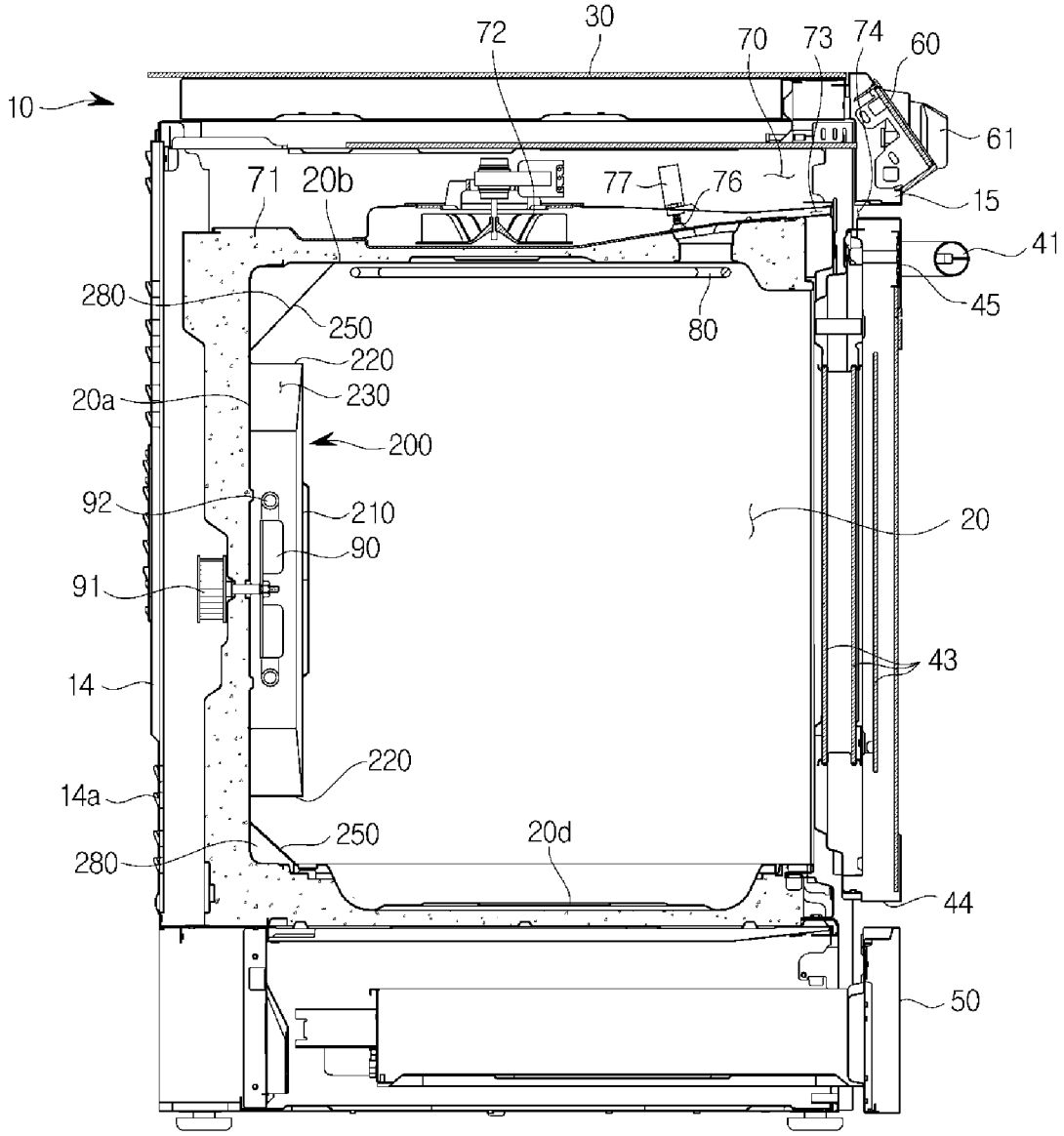
FIG. 14 is a side cross-sectional view of an oven according to an embodiment of the present disclosure.
Figure 15:
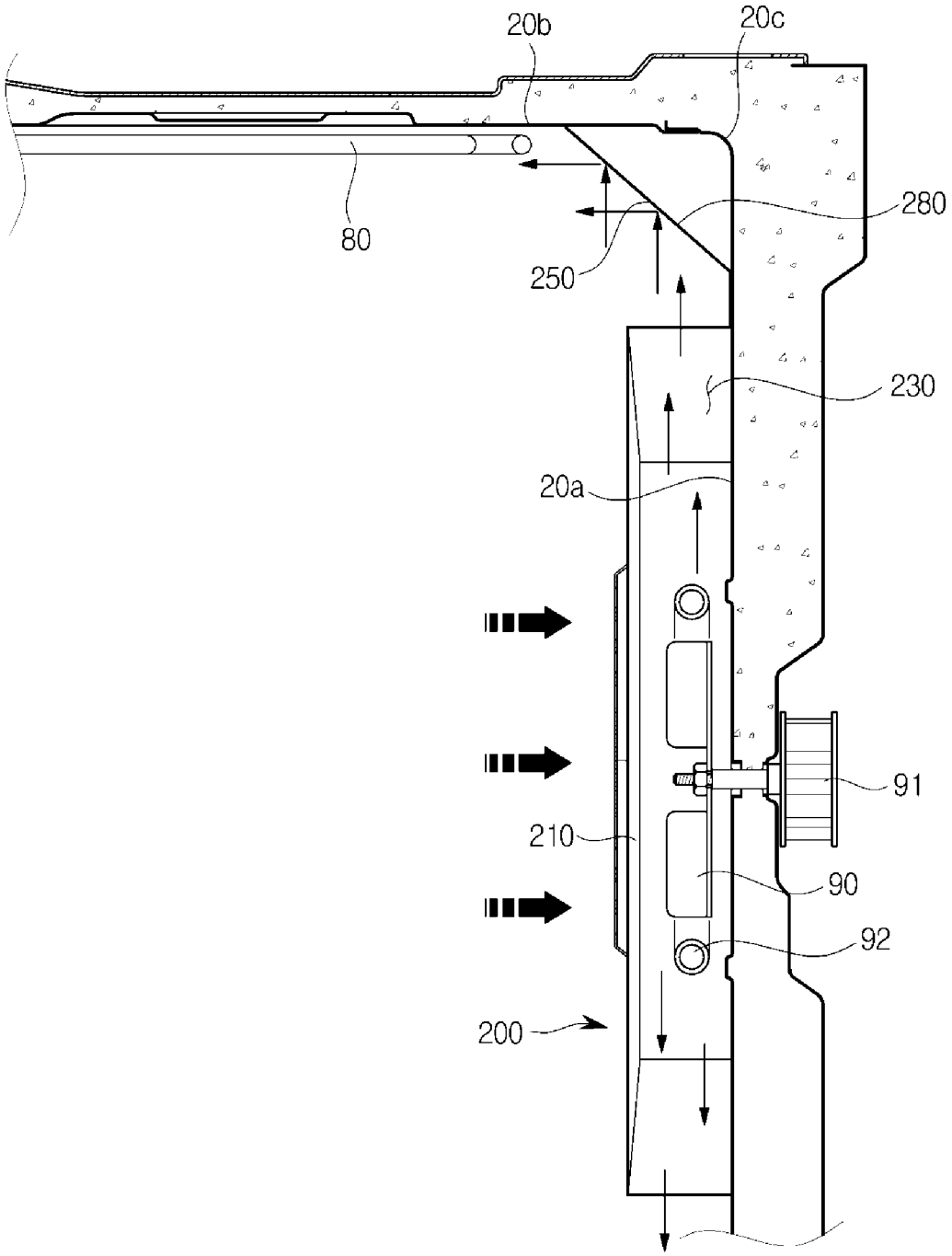
FIG. 15 is a view showing a part of the structure of an oven according to an embodiment of the present disclosure.

As shown in FIG. 11, according to an embodiment of the present disclosure, the filter 161 may be provided on the inlet 110 to collect the circulated oil mist. In detail, the filter 161 including a plurality of holes smaller than the plurality of holes of the grill 160 may be disposed on the front side of the grill 160.

The filter 161 is circulated in the cooking compartment 20 and collides with the air flowing into the inlet 110 by the fan 90 and the oil mist may condense on the surface area of the filter 161 due to the air collision.

Accordingly, the surface area of the filter 161 may collect the oil mist. This is for collecting the oil mist in the filter 161 disposed adjacent to the fan side heater 92 and heating the fan side heater 92 to easily remove the oil mist.

The heater 80 or the fan side heater 92 is heated during the cleaning mode of the oven 1 in order to remove the oil mist. If the oil mist is collected at a distance from the heater 80 or the fan side heater 92, the amount of heat generated by the fan side heater 92 may not reach the distance so that the thermal efficiency of the heater 80 or the fan side heater 92 may be lowered.

Therefore, the filter 161 may collect the oil mist at a position adjacent to the fan side heater 92, thereby increasing the thermal efficiency of the fan side heater 92. It is possible to reduce the amount of the oil mist flowing into the cooking compartment 20 by reducing the amount of the oil mist contained in the air, thereby reducing the amount of the oil mist condensed in the cooking compartment 20.

Hereinafter, a cover member 200 according to an embodiment of the present disclosure will be described. The configuration other than the configuration of the cover member 200 described below is the same as that of the above-described disclosure and a description thereof will be omitted. Further, an embodiment of the present disclosure may be applied to the cover member 200 according to an embodiment of the present disclosure described below.

As shown in FIGS. 12 to 15, the cover member 200 may be arranged to cover the fan 90 on the side of the rear wall 20*a* of the cooking compartment 20 where the fan 90 is disposed.

The cover member 200 may extend in the vertical direction of the rear wall 20*a* and an inlet 210 through which the air flows may be provided in front of the cover member 200. A pair of outlets 220 through which the air is discharged may be disposed at opposite ends of the cover member 200, and an air flow path 230 may be provided between the rear wall 20*a* and the cover member 200.

The pair of outlets 220 may be selectively formed only on the upper side or the lower side of the cover member 200 as a single so as to only face the upper wall 20*b* or the lower wall 20*d*.

Hereinafter, because the pair of outlets 220 are provided symmetrically, the outlet 220 disposed above the cover member 200 with respect to the pair of outlets 220 will be mainly described. Accordingly, the pair of outlets 220 are represented by the outlet 220 provided on the upper side of the cover member 200.

The air introduced into the cover member 200 by the fan 90 flows upward through the air flow path 230 and may be discharged to the outside of the cover member 200 by the outlet 220.

When the air collides with the inner wall of the cooking compartment 20 as in the above-described embodiment of the present disclosure, the oil mist in the air collides with the inner wall of the cooking compartment 20 and condenses on the surface of the cooking compartment 20. At this time, if the air discharge is scattered from the cover member 200, the inside of the cooking compartment 20 may be contaminated, and thus may cause inconvenience to the user.

In order to prevent this, the cover member 200 of the present disclosure is configured such that the cover member 200 intensively discharges the oil mist toward the upper wall 20*b*, especially the first corner portion 20*c* where the upper wall 20*b* and the rear wall 20*a* are connected, to collect the oil mist intensively on the first corner portion 20*c* as shown in FIGS. 12 to 15.

The outlet 220 of the cover member 200 may be formed to face the upper wall 20*b*. The air discharged from the outlet 220 may be discharged toward the upper wall 20*b* of the cooking compartment 20. At this time, the discharged air collides with the upper wall 20*b*, and then the flow direction is switched to the front side of the cooking compartment 20 and circulated in the cooking compartment 20.

The first corner portion 20*c* of the cooking compartment 20 may be provided with a collision member 280 that collides with the air discharged from the outlet 220. The collision member 280 may collide with the discharged air so that the oil mist in the air condenses on the surface of the collision member 280 to collect the oil mist and may guide the collided air to the front side of the cooking compartment 20.

The collision member 280 may be disposed on the upper side of the cover member 200 and may be formed integrally with the cover member 200, extending from the upper side of the cover member 200, according to an embodiment of the present disclosure. However, the collision member 280 may be formed independently of the cover member 200 without limitation thereto.

The collision member 280 may be arranged to be inclined from the rear wall 20*a* toward the upper wall 20*b*. An inclined surface of the collision member 280 may be disposed toward the front of the cooking compartment 20 so that the collision member 280 may cover the first corner portion 20*c* of the cooking compartment 20.

The air discharged from the outlet 220 collides with the inclined surface of the collision member 280 so that the oil mist in the air is collected on the inclined surface of the collision member 280 and the air guided to the front of the cooking compartment 20 along the inclined surface to be easily circulated inside of the cooking compartment 20.

A collision area 250 of the oven 1 according to an embodiment of the present disclosure may be provided on the inclined surface of the collision member 280 because the air is collided on the inclined surface of the collision member 280 as described above.

The oil mist in the air circulating inside the cooking compartment 20 collected on the collision area 250 may be easily removed by the heater 80 disposed adjacent to the collision member 280.

The heater 80 may be heated to a high temperature of 400° C. or higher so that the oil mist collected in the collision member 280 arranged adjacent to the heater 80 may be easily burned by the high temperature generated in the heater 80.

The longer the distance from the heater 80, the less the amount of heat that the heat generated by the heater 80 reaches, and the heat of high temperature may not be transmitted. Therefore, in the case of the oil mist which is collected on the inner wall of the cooking compartment 20 which is remote from the heater 80 and farther away from the heater 80 than the collision member 280, the amount of heat that burns the oil mist is not sufficiently supplied, so that amount of the oil mist removed may be reduced.

Because the collision member 280 is disposed adjacent to the heater 80, the heat of the heater 80 may be easily transferred to the oil mist trapped in the collision member 280. In the case of the collision member 280 disposed adjacent to the outlet 220 disposed on the lower side, a heater (not shown) is disposed below the lower wall 20*d* of the cooking compartment 20 so that the oil mist collected on the collision member 280 near the lower wall 20*d* may be smoothly removed.

Figure 16:
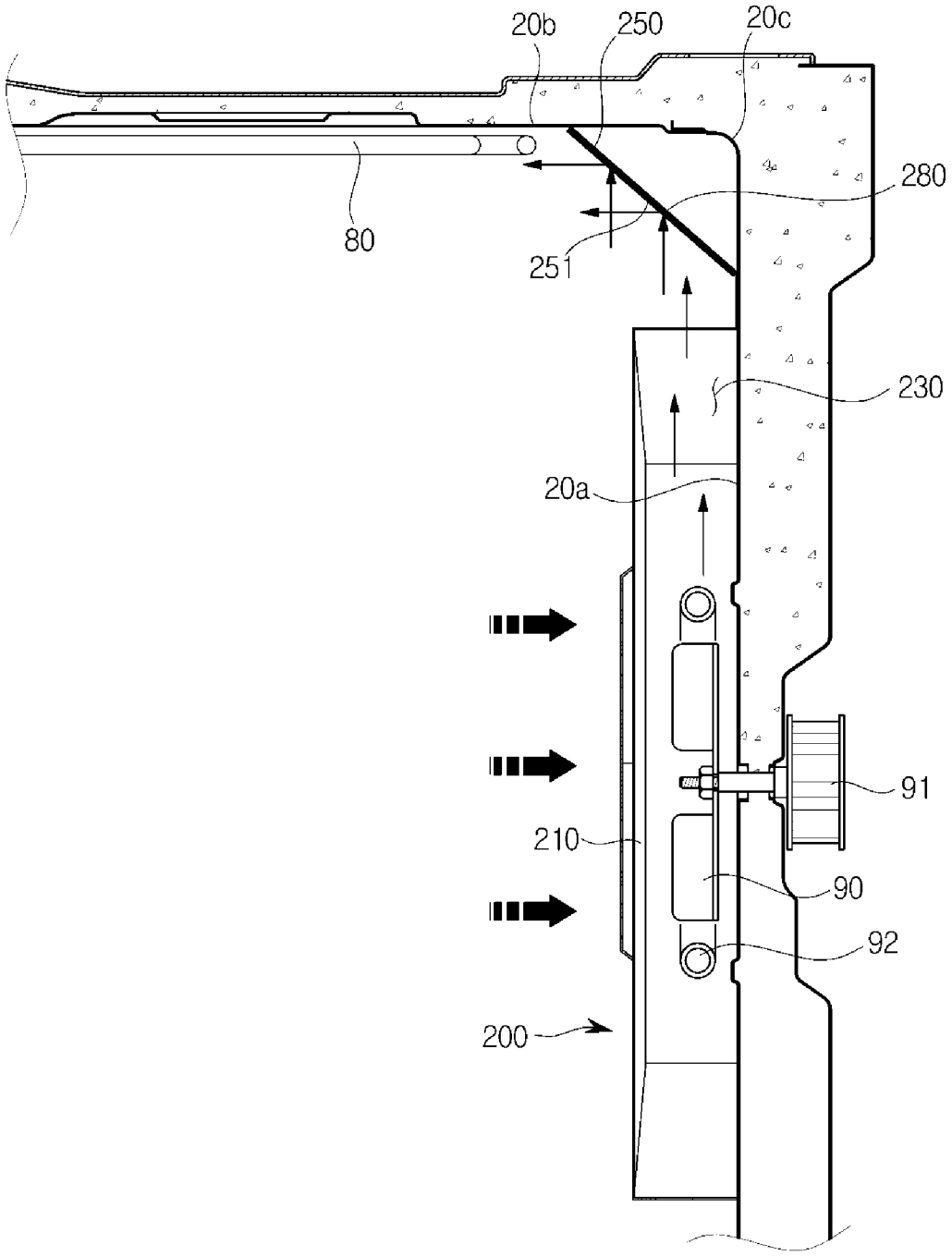
FIG. 16 is a view showing a part of the structure of an oven according to an embodiment of the present disclosure.

As shown in FIG. 16, the combustion promoting coating portion 251 may be provided in the collision area 250 of the collision member 280. This helps the burning of the oil mist collected in the collision area 250 and the removal of the oil mist as in the above-described an embodiment of the present disclosure.

The combustion promoting coating portion 251 may include the above-described catalyst coating or the surface heating coating.

Figure 17:
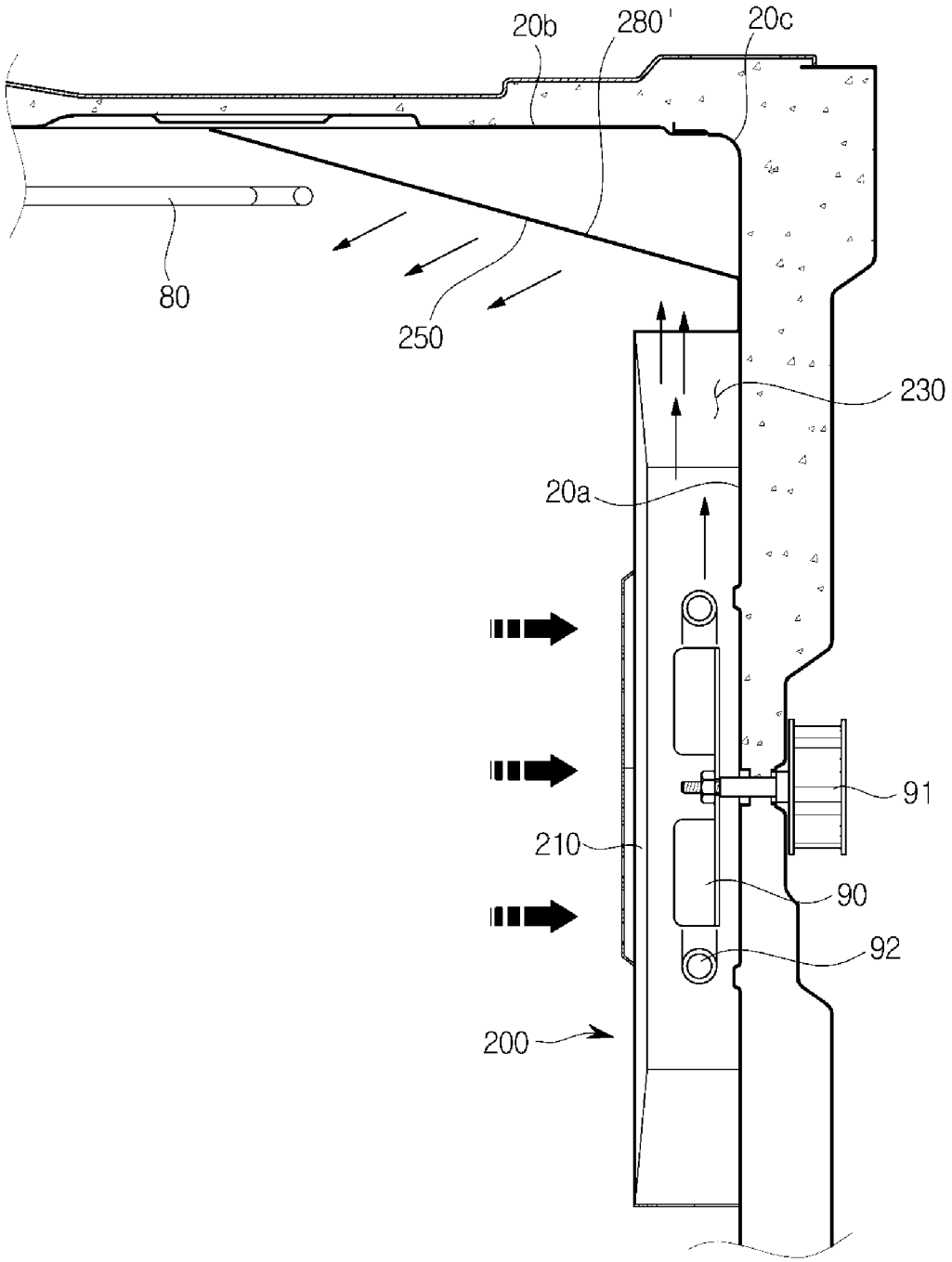
FIG. 17 is a view showing a part of the structure of an oven according to an embodiment of the present disclosure.
Figure 18:
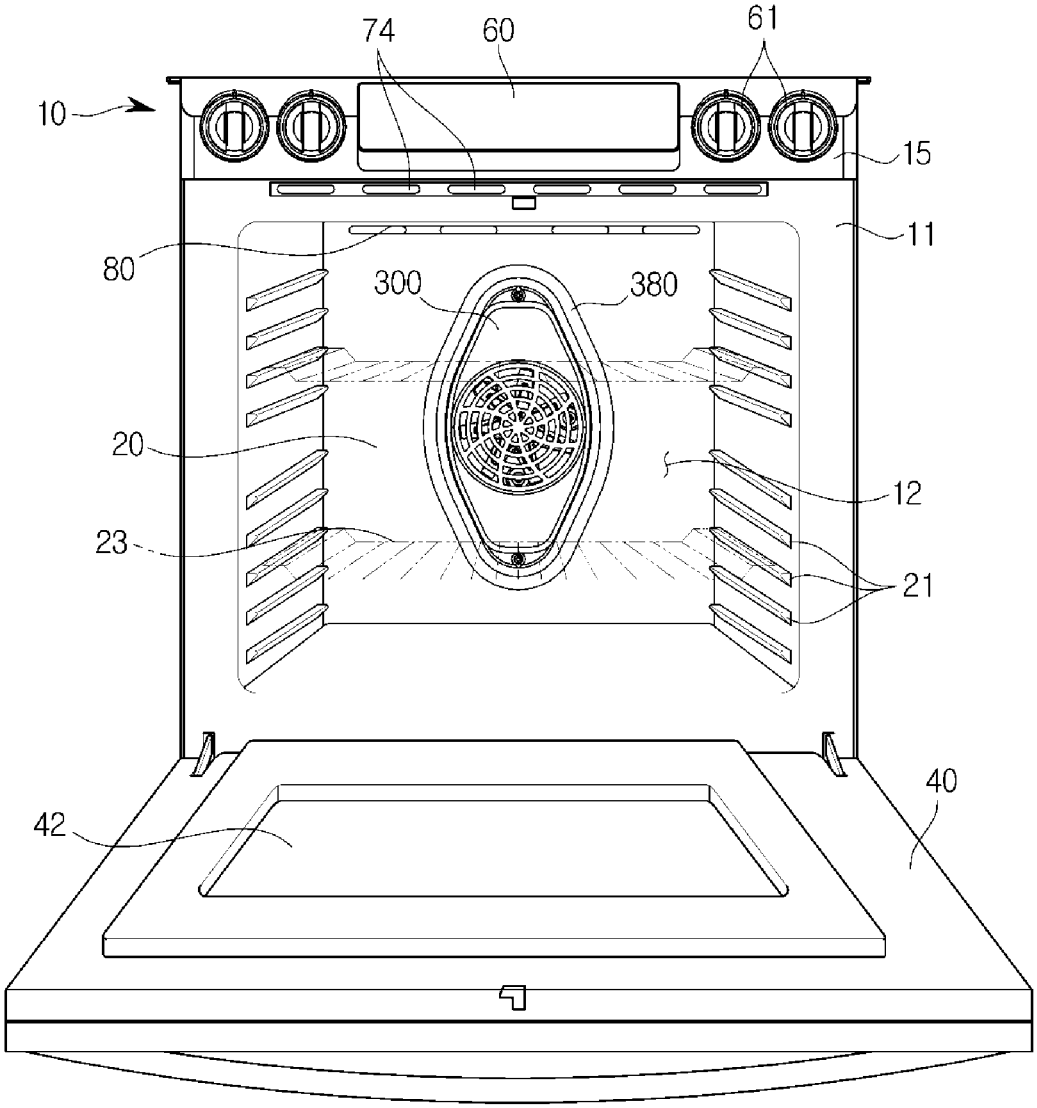
FIG. 18 is a view illustrating a state in which the door of the oven is opened according to an embodiment of the present disclosure.
Figure 19:
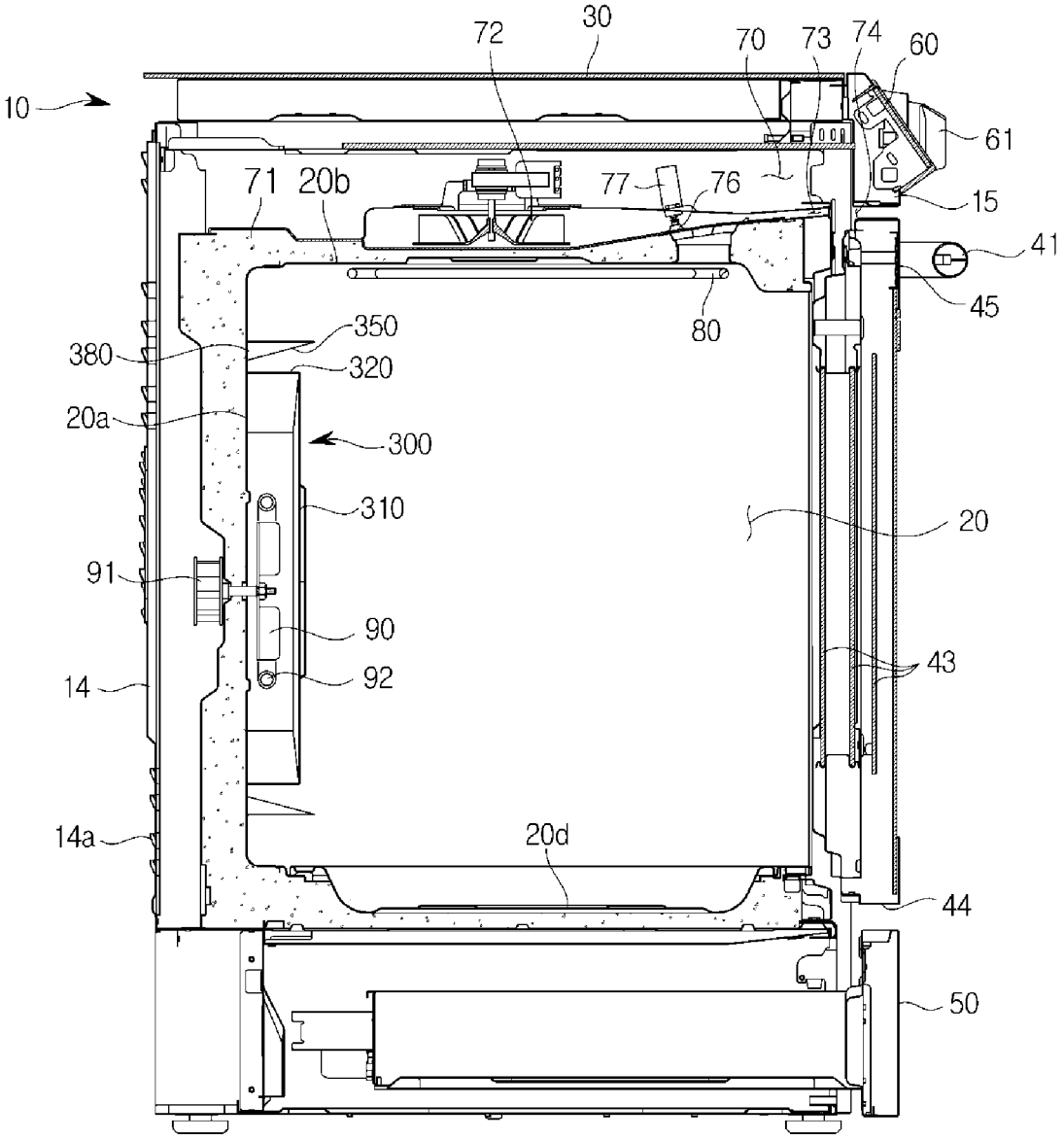
FIG. 19 is a side cross-sectional view of an oven according to an embodiment of the present disclosure.

As shown in FIG. 17, the collision member 280' extends from the rear wall 20*a* beyond the first corner portion 20*c* to the center of the upper wall 20*b* so as to cover the center of the upper wall 20*b*.

The air discharged from the outlet 220 is discharged toward the upper wall 20*b* and collides with the collision member 280' disposed on the first corner portion 20*c*, and then the discharged air may collide not only with the first corner portion 20*c* but also with the upper wall 20*b* adjacent to the first corner portion 20*c*.

At this time, the oil mist may collide with a side of the upper wall 20*b* adjacent to the first corner portion 20*c*, and may be collected on the upper wall 20*b*. More specifically, the air discharged from the outlet 220 flows along the first corner portion 20*c* to the upper wall 20*b*, and air discharged from the outlet 220 collides on the first corner 20*c* or the side of the upper wall 20*b* where the direction of the air flow changed, and the oil mist in the air may be collected not only on the collision member 280' but also on the side of the upper wall 20*b*.

Thus, the collision member 280' is extended to the side of the upper wall 20*b* adjacent to the first corner portion 20*c* in order to collect the oil mist of air on the side of the upper wall 20*b* adjacent to the first corner portion 20*c*.

A length in which the collision member 280' extends obliquely toward the upper wall 20*b* is not limited to an embodiment of the present disclosure and may be modified in consideration of the size of the cooking compartment 20 and the rotation speed of the fan 90.

The collision member 280' may extend to the center side of the upper wall 20*b* as shown in FIG. 17, may extend to one side between the center side of the upper wall 20*b* and the first corner portion 20*c*, and may extend to the front side of the cooking compartment 20 more than the center side of the upper wall 20*b*.

Hereinafter, a cover member 300 according to an embodiment of the present disclosure will be described.

As shown in FIGS. 18 to 21, the cover member 300 according to an embodiment of the present disclosure may be provided in a shape similar to the cover member disclosed in the conventional oven.

The cover member disclosed in the conventional oven covers the fan and air introduced into the cover member though inlet 310 by the fan at the outlet provided along the outer circumferential surface of the cover member is discharged and circulated in the cooking compartment.

At this time, the air discharged along the outer circumferential surface of the cover member is circulated in the cooking compartment, and collides with the entire inner wall of the cooking compartment. In order to prevent this, the oven 1 according to an embodiment of the present disclosure may include a collision member 380 surrounding the outer circumferential surface of the cover member 300 on the outer side of the cover member 300.

The air flowing through an air flow path 330 and discharged from an outlet 320 disposed along the outer circumferential surface of the cover member 300 may be circulated in the cooking compartment 20 after primarily colliding with the collision member 380 before colliding with the inside of the cooking compartment 20.

At this time, the discharged air is first collided with the collision member 380, so that the oil mist in the air may be captured by the collision member 380. The pollution degree on the inside of the cooking compartment 20 may be reduced because the air circulates in the cooking compartment 20 in the state after the oil mist in the air is collected by the collision member 380.

The collision member 380 may be disposed around the circumferential surface of the cover member 300 as described above, and may be inclined forward from the rear wall 20*a* so as to collide with the air discharged from the outlet 320 and to guide the air to the front side of the cooking compartment 20.

At this time, the air discharged from the outlet 320 collides with the inclined surface of the collision member 380, and the oil mist in the air is collected on the inclined surface of the collision member 380. Then, the air may be guided to the front of the cooking compartment 20 through the inclined surface.

A collision area 350 of the oven 1 according to an embodiment of the present disclosure may be provided on the inclined surface of the collision member 380 because the air collides with the inclined surface of the collision member 380.

Figure 20:
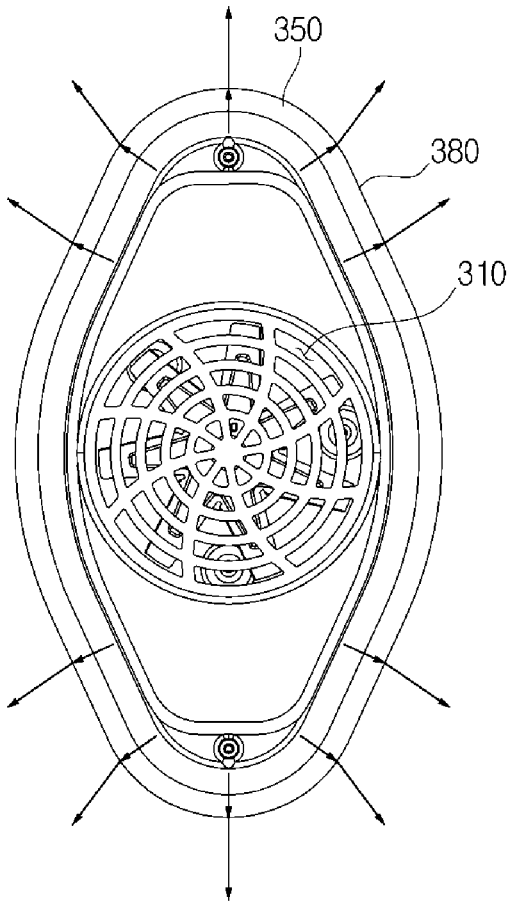
FIG. 20 is a front view of a cover member of an oven according to an embodiment of the present disclosure.
Figure 21:
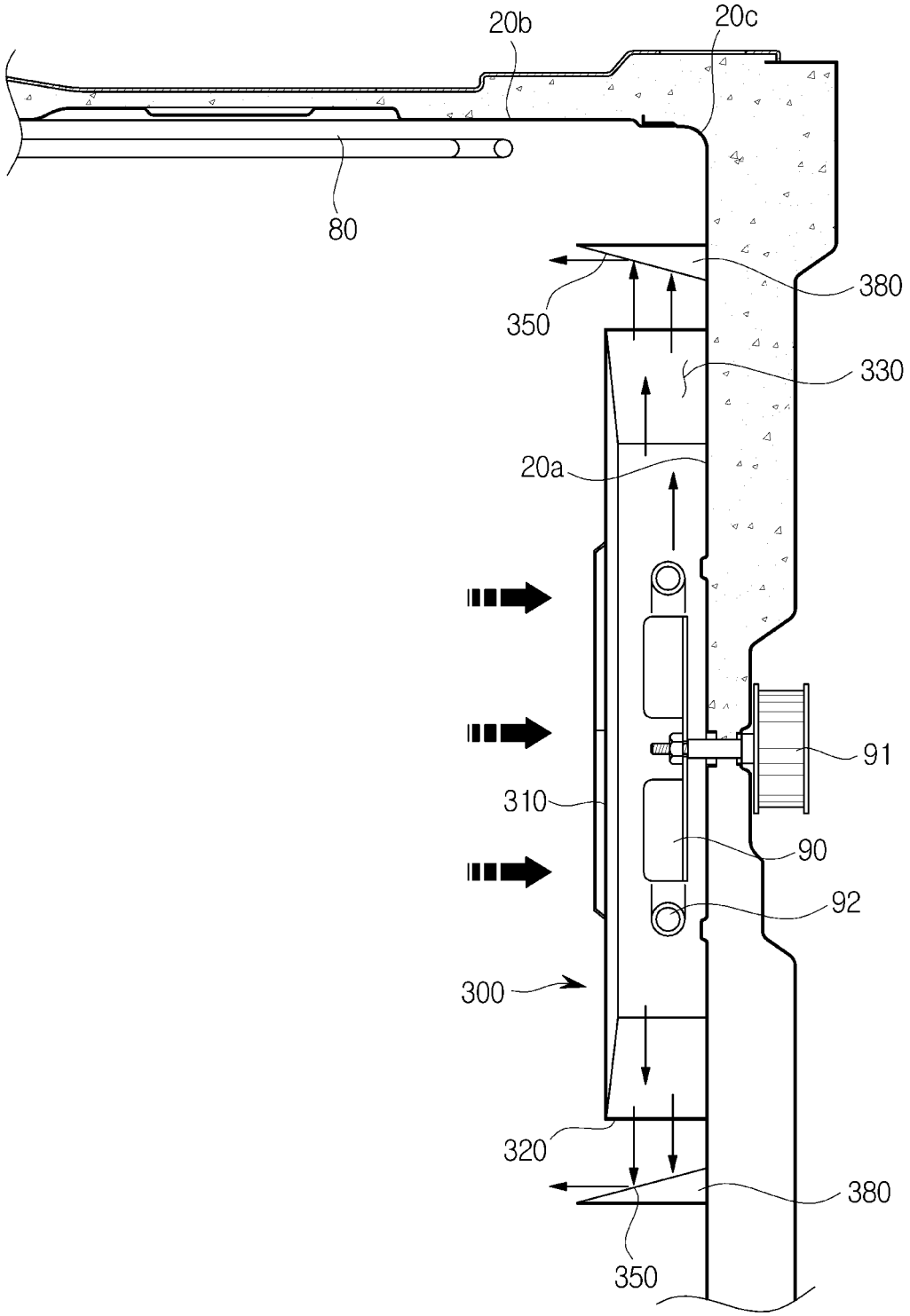
FIG. 21 is a view showing a part of the structure of an oven according to an embodiment of the present disclosure.

The cover member 300 provided so that the first distance A that is a distance from a rotation axis of the fan 90 to the outer circumferential surface of the fan 90 is shorter than the second distance B that is from the outer circumferential surface of the fan 90 to the outlet 320. Accordingly, as shown in FIG. 20, the outlet 320 may be disposed on the upper and lower outer circumferential surfaces of the cover member 300.

This is because if the outlet 320 is located on the side of the outer circumferential surface of the cover member 300, then the second distance B may be shorter than the first distance A.

Figure 22:
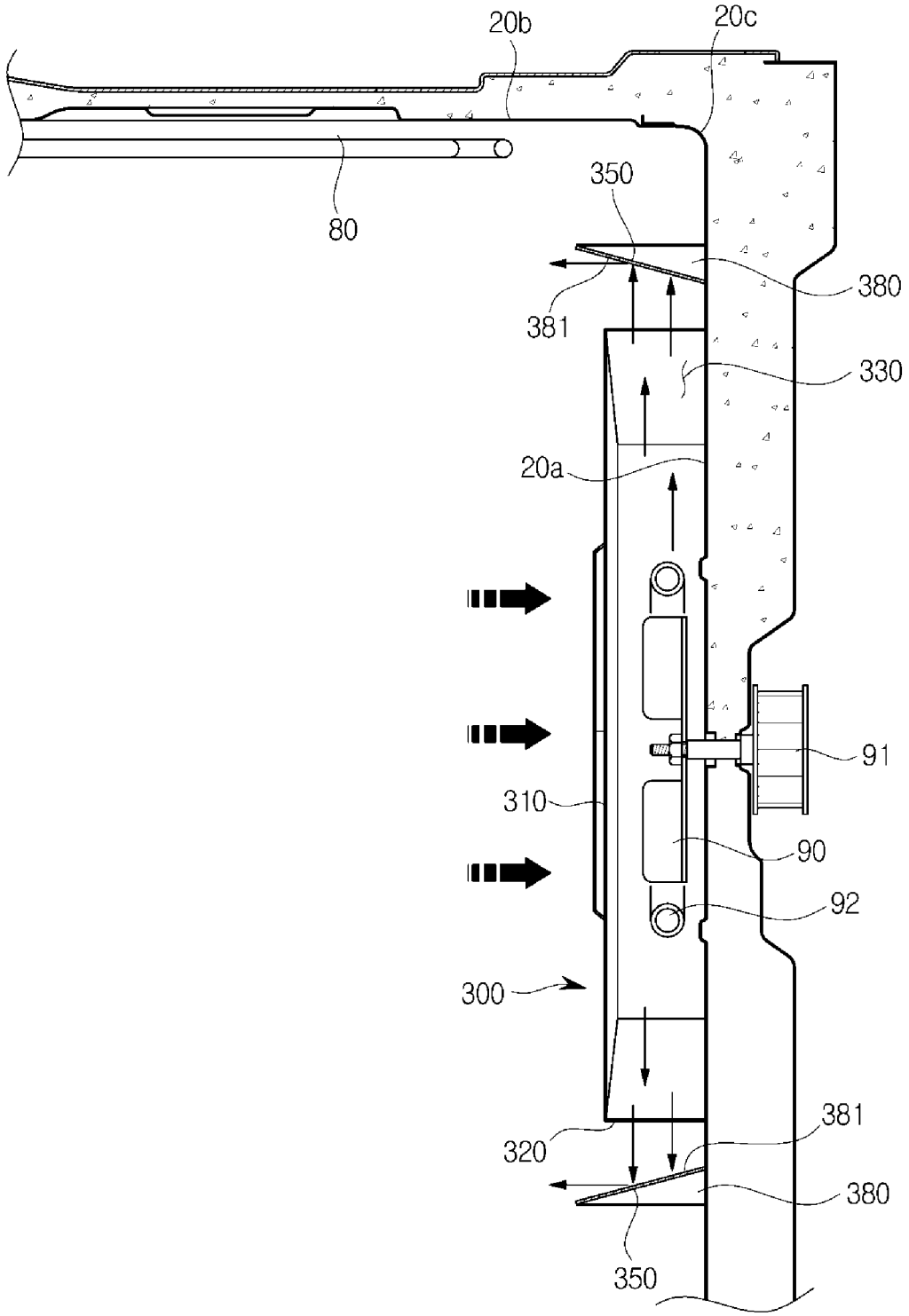
FIG. 22 is a view showing a part of the structure of an oven according to an embodiment of the present disclosure.

As shown in FIG. 22, a combustion promoting coating portion 381 may be provided in the collision area 350 of the collision member 380. This makes it possible to help the removal of the oil mist in the collision area 350 as in the above-described embodiment of the present disclosure. Moreover, the combustion promoting coating portion 381 may include the above-described catalyst coating or a surface heating coating.

The oven according to the present disclosure collects the oil mist inside the cooking compartment in a tight manner on one side of the cooking compartment so that the user can easily clean the inside of the cooking compartment and easily burn the concentrated oil mist to reduce the amount of cleaning.

The present disclosure is not limited to the above-described embodiments, and it should be clear to those skilled in the art that various modifications and changes may be made without departing from the scope of the present disclosure. Therefore, modified or changed embodiments are included in the range of the claims of the present disclosure.

What is claimed is:

1. An oven comprising:

a case;

a cooking compartment provided inside the case;

a heater configured to heat the cooking compartment;

a fan disposed in the cooking compartment and configured to circulate air inside the cooking compartment; and a cover disposed in the cooking compartment to divide the cooking compartment into a cooking space in which cooking is performed and an air flow path in which the fan is disposed, wherein the cover includes a first cover portion to guide air in the cooking space to a collision area where air collides on a surface of the cooking compartment, and a second cover portion provided to guide the air of the air flow path to the cooking space and to which the heater is mounted, and wherein a plurality of bumps are formed on a surface of the second cover portion, and the heater and an outlet through which the air in the air flow path is discharged into the cooking space are disposed on the plurality of bumps.

2. The oven of claim 1, wherein the air flow path is formed between the cover and the surface of the cooking compartment, wherein the collision area is provided on the air flow path.

3. The oven of claim 2, wherein the air flow path includes a first flow path provided between the fan and the collision area, and a second flow path provided between the collision area and the outlet, and the second flow path forms an angle of at least 80 degrees with the first flow path.

4. The oven of claim 1, wherein the collision area is provided on a corner where a rear surface of the cooking compartment and an upper surface of the cooking compartment are connected.

5. The oven of claim 1, wherein the collision area includes a catalyst coating portion disposed on a surface of the collision area and configured to act as a catalyst when the oil mist condensed on the collision area by the collision of the circulated air with the collision area is burned.

6. The oven of claim 1, wherein the collision area includes a surface heating coating portion disposed on a surface of the collision area and configured to heat the oil mist condensed on the collision area by the collision of the circulated air with the collision area.

7. The oven of claim 1, wherein the collision area includes an auxiliary heater disposed adjacent to the collision area and configured to heat the oil mist condensed on the collision area by the collision of the circulated air with the collision area.

8. The oven of claim 1, wherein the heater includes a hot-wire and a plurality of fins disposed on the hot-wire.

9. The oven of claim 1, wherein the heater includes a hot-wire and a mesh member to cover the hot-wire.

10. The oven of claim 2, further comprising a fan side heater surrounding the fan on an outer circumferential side of the fan, wherein the cover member further includes an inlet through which air is introduced to the cover member and a filter disposed on the inlet.

11. The oven of claim 1, further comprising a collision member disposed adjacent to an outlet through which air circulated by the fan is discharged to an outside of the cover member, wherein the collision area is provided on the collision member.

12. The oven of claim 11, wherein the outlet is formed toward an upper surface of the cooking compartment connected to a first surface of the cooking compartment, and the collision member is inclined from the upper surface of the cooking compartment.

13. The oven of claim 11, wherein the collision member is disposed to be inclined with respect to a direction of air flow discharged from the outlet.

14. The oven of claim 2, wherein the cover further comprises an inlet having a circular shape through which air circulated by the fan flows into the cover and an outlet through which air circulated by the fan is discharged to an outside of the cover, and provided so that a shortest distance between the fan and the outlet is longer than a longest distance between a center of the inlet and an outer perimeter of the inlet.

15. An oven comprising:

a case;

a cooking compartment provided inside the case;

a heater configured to heat the cooking compartment;

a fan disposed in the cooking compartment and configured to circulate air inside the cooking compartment;

a cover disposed in the cooking compartment and configured to cover the fan and having a bent portion provided at a corner of the cooking compartment; and an air flow path formed between the cover and a surface of the cooking compartment in which the air circulated by the fan flows, wherein the cover includes a first cover portion to suck air into the air flow path and guide the air of the air flow path to a collision area where air collides on a surface of the cooking compartment, and a second cover portion provided to discharge the air of the air flow path and to which the heater is mounted, and wherein a plurality of bumps are formed on a surface of the second cover portion, and the heater and an outlet through which the air in the air flow path is discharged are disposed on the plurality of bumps.

16. The oven of claim 15, wherein the collision area provided on the corner and configured to redirect the flow of air in the air flow path and received from the fan, so that at least a portion of the air is redirected in a different direction and at least a portion of an oil mist suspended in the air is condensed on the collision area, such that condensation of the oil mist in the cooking compartment is concentrated in the collision area.

17. The oven of claim 15, wherein the cover includes an inlet through which air is introduced into the cover, the air flow path includes a first flow path provided between the inlet and the collision area, and a second flow path provided between the collision area and the outlet, and the second flow path forms an angle of at least 80 degrees with the first flow path.

18. The oven of claim 16, wherein the collision area includes a combustion promoting coating portion disposed on a surface of the collision area and configured to promote a burning of the oil mist condensed on the collision area.

19. The oven of claim 1, wherein the plurality of bumps include a concave portion, and the heater is disposed on the concave portion.

20. The oven of claim 1, wherein the plurality of bumps include a convex portion protruding toward the cooking space, and the outlet is disposed on the convex portion.

* * * * *